US005912976A

United States Patent [19]

Klayman et al.

[11] Patent Number: 5,912,976

[45] Date of Patent: Jun. 15, 1999

[54] MULTI-CHANNEL AUDIO ENHANCEMENT SYSTEM FOR USE IN RECORDING AND PLAYBACK AND METHODS FOR PROVIDING SAME

[75] Inventors: Arnold I. Klayman, Huntington Beach; Alan D. Kraemer, Tustin, both of Calif.

[73] Assignee: SRS Labs, Inc., Irvine, Calif.

[21] Appl. No.: 08/743,776

[22] Filed: Nov. 7, 1996

[51] Int. Cl.[6] ..... H04R 5/00

[52] U.S. Cl. ..... 381/18; 381/1

[58] Field of Search ..... 381/1, 17, 18, 381/19, 20, 22, 23, 307, 300, 27

[56] References Cited

U.S. PATENT DOCUMENTS

| | | |
|---|---|---|
| 3,170,991 | 2/1965 | Glasgal . |
| 3,229,038 | 1/1966 | Richter . |

(List continued on next page.)

FOREIGN PATENT DOCUMENTS

| | | |
|---|---|---|
| 0 097 982 A3 | 1/1984 | European Pat. Off. . |
| 0 320 270 A2 | 6/1989 | European Pat. Off. . |
| 0 367 569 A2 | 10/1989 | European Pat. Off. . |
| 0 354 517 A2 | 2/1990 | European Pat. Off. . |
| 0 357 402 A2 | 3/1990 | European Pat. Off. . |
| 35 014 | 2/1966 | Finland . |
| 33 31 352 A1 | 3/1985 | Germany . |
| 40-29936 | 10/1940 | Japan . |
| 43-12585 | 5/1943 | Japan . |
| 58-144989 | 9/1983 | Japan . |
| 59-27692 | 2/1984 | Japan . |
| 61-33600 | 2/1986 | Japan . |
| 61-166696 | 10/1986 | Japan . |
| 2 154 835 | 9/1985 | United Kingdom . |
| 2 277 855 | 9/1994 | United Kingdom . |
| WO 87/06090 | 10/1987 | WIPO . |
| WO 94/16548 | 7/1994 | WIPO . |
| WO 96/34509 | 10/1996 | WIPO . |

OTHER PUBLICATIONS

Schroeder, M.R., "An Artificial Stereophonic Effect Obtained from a Single Audio Signal", *Journal of the Audio Engineering Society,* vol. 6, No. 2, pp. 74–79, Apr. 1958.

Kurozumi, K., et al., "A New Sound Image Broadening Control System Using a Correlation Coefficient Variation Method", *Electronics and Communications in Japan,* vol. 67–A, No. 3, pp. 204–211, Mar. 1984.

Sundberg, J., "The Acoustics of the Singing Voice", *The Physics of Music,* pp. 16–23, 1978.

Ishihara, M., "A New Analog Signal Processor For A Stereo Enhancement System", *IEEE Transactions on Consumer Electronics,* vol. 37, No. 4, pp. 806–813, Nov. 1991.

Allison, R., "The Loudspeaker / Living Room System", *Audio,* pp. 18–22, Nov. 1971.

Vaughan, D., "How We Hear Direction", *Audio,* pp. 51–55, Dec. 1983.

(List continued on next page.)

*Primary Examiner*—Minsun Oh Harvey
*Attorney, Agent, or Firm*—Knobbe, Martens, Olson & Bear LLP

[57] ABSTRACT

An audio enhancement system and method for use receives a group of multi-channel audio signals and provides a simulated surround sound environment through playback of only two output signals. The multi-channel audio signals comprise a pair of front signals intended for playback from a forward sound stage and a pair of rear signals intended for playback from a rear sound stage. The front and rear signals are modified in pairs by separating an ambient component of each pair of signals from a direct component and processing at least some of the components with a head-related transfer function. Processing of the individual audio signal components is determined by an intended playback position of the corresponding original audio signals. The individual audio signal components are then selectively combined with the original audio signals to form two enhanced output signals for generating a surround sound experience upon playback.

48 Claims, 10 Drawing Sheets

U.S. PATENT DOCUMENTS

| | | | |
|---|---|---|---|
| 3,246,081 | 4/1966 | Edwards . | |
| 3,249,696 | 5/1966 | Van Sickle . | |
| 3,665,105 | 5/1972 | Chowning . | |
| 3,697,692 | 10/1972 | Hafler . | |
| 3,725,586 | 4/1973 | Iida . | |
| 3,745,254 | 7/1973 | Ohta et al. . | |
| 3,757,047 | 9/1973 | Ito et al. . | |
| 3,761,631 | 9/1973 | Ito et al. . | |
| 3,772,479 | 11/1973 | Hilbert . | |
| 3,849,600 | 11/1974 | Ohshima . | |
| 3,885,101 | 5/1975 | Ito et al. . | |
| 3,892,624 | 7/1975 | Shimada . | |
| 3,925,615 | 12/1975 | Nakano . | |
| 3,943,293 | 3/1976 | Bailey . | |
| 4,024,344 | 5/1977 | Dolby et al. . | |
| 4,063,034 | 12/1977 | Peters . | |
| 4,069,394 | 1/1978 | Doi et al. . | |
| 4,118,599 | 10/1978 | Iwahara et al. . | |
| 4,139,728 | 2/1979 | Haramoto et al. . | |
| 4,192,969 | 3/1980 | Iwahara . | |
| 4,204,092 | 5/1980 | Bruney . | |
| 4,209,665 | 6/1980 | Iwahara . | |
| 4,218,583 | 8/1980 | Poulo . | |
| 4,218,585 | 8/1980 | Carver . | |
| 4,219,696 | 8/1980 | Kogure et al. . | |
| 4,237,343 | 12/1980 | Kurtin et al. . | |
| 4,239,937 | 12/1980 | Kampmann . | |
| 4,303,800 | 12/1981 | DeFreitas . | |
| 4,308,423 | 12/1981 | Cohen . | |
| 4,308,424 | 12/1981 | Bice, Jr. . | |
| 4,309,570 | 1/1982 | Carver . | |
| 4,332,979 | 6/1982 | Fischer . | |
| 4,349,698 | 9/1982 | Iwahara . | |
| 4,355,203 | 10/1982 | Cohen . | |
| 4,356,349 | 10/1982 | Robinson . | |
| 4,393,270 | 7/1983 | Van Den Berg . | |
| 4,394,536 | 7/1983 | Shima et al. . | |
| 4,408,095 | 10/1983 | Ariga et al. . | |
| 4,479,235 | 10/1984 | Griffis . | |
| 4,489,432 | 12/1984 | Polk . | |
| 4,495,637 | 1/1985 | Bruney . | |
| 4,497,064 | 1/1985 | Polk . | |
| 4,503,554 | 3/1985 | Davis . | |
| 4,567,607 | 1/1986 | Bruney et al. . | |
| 4,569,074 | 2/1986 | Polk . | |
| 4,589,129 | 5/1986 | Blackmer et al. . | |
| 4,594,610 | 6/1986 | Patel . | |
| 4,594,729 | 6/1986 | Weingartner . | |
| 4,594,730 | 6/1986 | Rosen . | |
| 4,622,691 | 11/1986 | Tokumo et al. . | |
| 4,648,117 | 3/1987 | Kunugi et al. . | |
| 4,696,036 | 9/1987 | Julstrom . | |
| 4,703,502 | 10/1987 | Kasai et al. . | |
| 4,748,669 | 5/1988 | Klayman . | |
| 4,856,064 | 8/1989 | Iwamatsu . | |
| 4,866,774 | 9/1989 | Klayman . | |
| 4,866,776 | 9/1989 | Kasai et al. . | |
| 4,888,809 | 12/1989 | Knibbeler . | |
| 4,933,768 | 6/1990 | Ishikawa | 381/1 |
| 4,953,213 | 8/1990 | Tasaki et al. . | |
| 5,033,092 | 7/1991 | Sadaie . | |
| 5,046,097 | 9/1991 | Lowe et al. . | |
| 5,105,462 | 4/1992 | Lowe et al. . | |
| 5,146,507 | 9/1992 | Satoh et al. . | |
| 5,208,860 | 5/1993 | Lowe et al. . | |
| 5,228,085 | 7/1993 | Aylward . | |
| 5,251,260 | 10/1993 | Gates . | |
| 5,319,713 | 6/1994 | Waller, Jr. et al. . | |
| 5,325,435 | 6/1994 | Date et al. . | |
| 5,371,799 | 12/1994 | Lowe et al. . | |
| 5,400,405 | 3/1995 | Petroff . | |
| 5,572,591 | 11/1996 | Numazu | 381/1 |
| 5,677,957 | 10/1997 | Hulsebus | 381/17 |
| 5,734,724 | 3/1998 | Kinoshita | 381/17 |
| 5,742,688 | 4/1998 | Ogawa | 381/17 |
| 5,771,295 | 6/1998 | Waller | 381/18 |
| 5,799,094 | 8/1998 | Mouri | 381/18 |

OTHER PUBLICATIONS

Stevens, S., et al, "Chapter 5: The Two–Earned Man", *Sound And Hearing,* pp. 98–106 and 196, 1965.

Eargle, J., "Multichannel Stereo Matrix Systems: An Overview", *Journal of the Audio Engineering Society,* pp. 552–558 (no date listed).

Wilson, Kim, "AC–3 Is Here! But Are You Ready To Pay The Price?", *Home Theater,* pp. 60–65, Jun. 1995.

Copy of International Search Report dated Mar. 10, 1998 from corresponding PCT application.

Kaufman, Richard J., "Frequency Contouring For Image Enhancement", *Audio,* pp. 34–39, Feb. 1985.

MULTI-CHANNEL AUDIO ENHANCEMENT SYSTEM FOR USE IN RECORDING AND PLAYBACK AND METHODS FOR PROVIDING SAME

FIELD OF THE INVENTION

This invention relates generally to audio enhancement systems and methods for improving the realism and dramatic effects obtainable from two channel sound reproduction. More particularly, this invention relates to apparatus and methods for enhancing multiple audio signals and mixing these audio signals into a two channel format for reproduction in a conventional playback system.

BACKGROUND OF THE INVENTION

Audio recording and playback systems can be characterized by the number of individual channel or tracks used to input and/or play back a group of sounds. In a basic stereo recording system, two channels each connected to a microphone may be used to record sounds detected from the distinct microphone locations. Upon playback, the sounds recording by the two channels are typically reproduced through a pair of loudspeakers, with one loudspeaker reproducing an individual channel. Providing two separate audio channels for recording permits individual processing of these channels to achieve an intended effect upon playback. Similarly, providing more discrete audio channels allows more freedom in isolating certain sounds to enable the separate processing of these sounds.

Professional audio studios use multiple channel recordings systems which can isolate and process numerous individual sounds. However, since many conventional audio reproduction devices are delivered in traditional stereo, use of a multi-channel system to record sounds requires that the sounds be "mixed" down to only two individual signals. In the professional audio recording world, studios employ such mixing methods since individual instruments and vocals of a given audio work may be initially recorded on separate tracks, but must be replayed in a stereo format found in conventional stereo systems. Professional systems may use 48 or more separate audio channels which are processed individually before recorded onto two stereo tracks.

In multi-channel playback systems, i.e., defined herein as systems having more than two individual audio channels, each sound recorded from an individual channel may be separately processed and played through a corresponding speaker or speakers. Thus, sounds which are recorded from, or intended to be placed at, multiple locations about a listener, can be realistically reproduced through a dedicated speaker placed at the appropriate location. Such systems have found particular use in theaters and other audio-visual environments where a captive and fixed audience experiences both an audio and visual presentation. These systems, which include Dolby Laboratories' "Dolby Digital" system; the Digital Theater System (DTS); and Sony's Dynamic Digital Sound (SDDS), are all designed to initially record and then reproduce multi-channel sounds to provide a surround listening experience.

In the personal computer and home theater arena, recorded media is being standardized so that multiple channels, in addition to the two conventional stereo channels, are stored on such recorded media. One such standard is Dolby's AC-3 multi-channel encoding standard which provides six separate audio signals. In the Dolby AC-3 system, two audio channels are intended for playback on forward left and right speakers, two channels are reproduced on rear left and right speakers, one channel is used for a forward center dialogue speaker, and one channel is used for low-frequency and effects signals. Audio playback systems which can accommodate the reproduction of all these six channels do not require that the signals be mixed into a two channel format. However, many playback systems, including today's typical personal computer and tomorrow's personal computer/television, may have only two channel playback capability (excluding center and subwoofer channels). Accordingly, the information present in additional audio signals, apart from that of the conventional stereo signals, like those found in an AC-3 recording, must either be electronically discarded or mixed into a two channel format.

There are various techniques and methods for mixing multi-channel signals into a two channel format. A simple mixing method may be to simply combine all of the signals into a two-channel format while adjusting only the relative gains of the mixed signals. Other techniques may apply frequency shaping, amplitude adjustments, time delays or phase shifts, or some combination of all of these, to an individual audio signal during the final mixing process. The particular technique or techniques used may depend on the format and content of the individual audio signals as well as the intended use of the final two channel mix.

For example, U.S. Pat. No. 4,393,270 issued to van den Berg discloses a method of processing electrical signals by modulating each individual signal corresponding to a preselected direction of perception which may compensate for placement of a loudspeaker. A separate multi-channel processing system is disclosed in U.S. Pat. No. 5,438,623 issued to Begault. In Begault, individual audio signals are divided into two signals which are each delayed and filtered according to a head related transfer function (HRTF) for the left and right ears. The resultant signals are then combined to generate left and right output signals intended for playback through a set of headphones.

The techniques found in the prior art, including those found in the professional recording arena, do not provide an effective method for mixing multi-channel signals into a two channel format to achieve a realistic audio reproduction through a limited number of discrete channels. As a result, much of the ambiance information which provides an immersive sense of sound perception may be lost or masked in the final mixed recording. Despite numerous previous methods of processing multi-channel audio signals to achieve a realistic experience through conventional two channel playback, there is much room for improvement to achieve the goal of a realistic listening experience.

Accordingly, it is an object of the present invention to provide an improved method of mixing multi-channel audio signals which can be used in all aspects of recording and playback to provide an improved and realistic listening experience. It is an object of the present invention to provide an improved system and method for mastering professional audio recordings intended for playback on a conventional stereo system. It is also an object of the present invention to provide a system and method to process multi-channel audio signals extracted from an audio-visual recording to provide an immersive listening experience when reproduced through a limited number of audio channels.

For example, personal computers and video players are emerging with the capability to record and reproduce digital video disks (DVD) having six or more discrete audio channels. However, since many such computers and video players do not have more than two audio playback channels (and possibly one sub-woofer channel), they cannot use the full amount of discrete audio channels as intended in a surround environment. Thus, there is a need in the art for a computer and other video delivery system which can effectively use all of the audio information available in such systems and provide a two channel listening experience which rivals multi-channel playback systems. The present invention fulfills this need.

SUMMARY OF THE INVENTION

An audio enhancement system and method is disclosed for processing a group of audio signals, representing sounds existing in a 360 degree sound field, and combining the group of audio signals to create a pair of signals which can accurately represent the 360 degree sound field when played through a pair of speakers. The audio enhancement system can be used as a professional recording system or in personal computers and other home audio systems which include a limited amount of audio reproduction channels.

In a preferred embodiment for use in a home audio reproduction system having stereo playback capability, a multi-channel recording provides multiple discrete audio signals consisting of at least a pair of left and right signals, a pair of surround signals, and a center channel signal. The home audio system is configured with speakers for reproducing two channels from a forward sound stage. The left and right signals and the surround signals are first processed and then mixed together to provide a pair of output signals for playback through the speakers. In particular, the left and right signals from the recording are processed collectively to provide a pair of spatially-corrected left and right signals to enhance sounds perceived by a listener as emanating from a forward sound stage.

The surround signals are collectively processed by first isolating the ambient and monophonic components of the surround signals. The ambient and monophonic components of the surround signals are modified to achieve a desired spatial effect and to separately correct for positioning of the playback speakers. When the surround signals are played through forward speakers as part of the composite output signals, the listener perceives the surround sounds as emanating from across the entire rear sound stage. Finally, the center signal may also be processed and mixed with the left, right and surround signals, or may be directed to a center channel speaker of the home reproduction system if one is present.

BRIEF DESCRIPTION OF THE DRAWINGS

The above and other aspects, features, and advantages of the present invention will be more apparent from the following particular description thereof presented in conjunction with the following drawings, wherein.

DETAILED DESCRIPTION OF THE PREFERRED EMBODIMENTS

Figure 1:
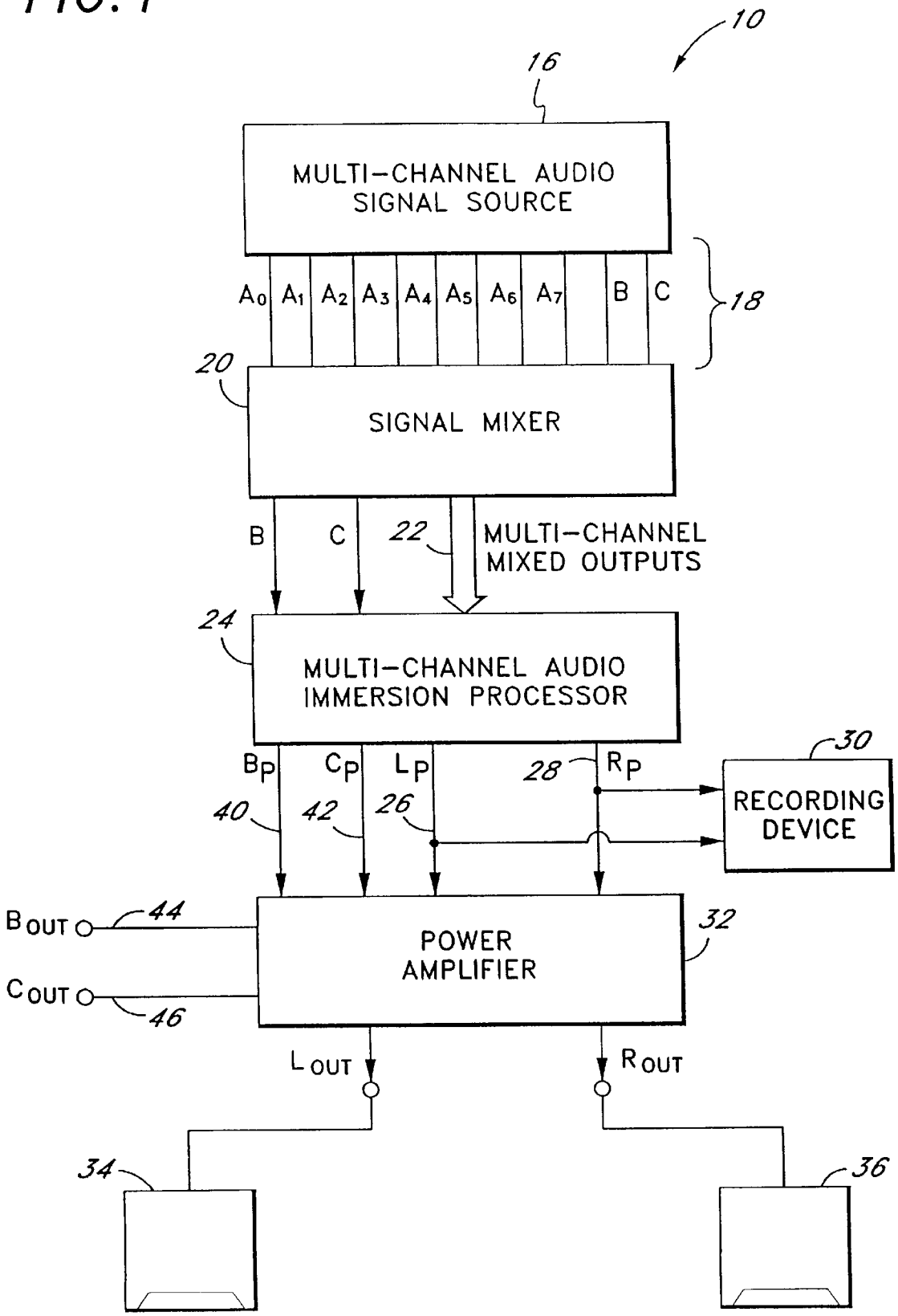
FIG. 1 is a schematic block diagram of a first embodiment of a multi-channel audio enhancement system for generating a pair of enhanced output signals to create a surround-sound effect.

FIG. 1 depicts a block diagram of a first preferred embodiment of a multi-channel audio enhancement system 10 for processing a group of audio signals and providing a pair of output signals. The audio enhancement system 10 comprises a source of multi-channel audio signal source 16 which outputs a group of discrete audio signals 18 to a multi-channel signal mixer 20. The mixer 20 provides a set of processed multi-channel outputs 22 to an audio immersion processor 24. The signal processor 24 provides a processed left channel signal 26 and a processed right channel signal 28 which can be directed to a recording device 30 or to a power amplifier 32 before reproduction by a pair of speakers 34 and 36. Depending upon the signal inputs 18 received by the processor 20, the signal mixer may also generate a bass audio signal 40 containing low-frequency information which corresponds to a bass signal, B, from the signal source 16, and/or a center audio signal 42 containing dialogue or other centrally located sounds which corresponds to a center signal, C, output from the signal source 16. Not all signal sources will provide a separate bass effects channel B, nor a center channel C, and therefore it is to be understood that these channels are shown as optional signal channels. After amplification by the amplifier 32, the signals 40 and 42 are represented by the output signals 44 and 46, respectively.

In operation, the audio enhancement system 10 of FIG. 1 receives audio information from the audio source 16. The audio information may be in the form of discrete analog or digital channels or as a digital data bitstream. For example, the audio source 16 may be signals generated from a group of microphones attached to various instruments in an orchestral or other audio performance. Alternatively, the audio source 16 may be a pre-recorded multi-track rendition of an audio work. In any event, the particular form of audio data received from the source 16 is not particularly relevant to the operation of the enhancement system 10.

For illustrative purposes, FIG. 1 depicts the source audio signals as comprising eight main channels $A_0$–$A_7$, a single bass or low-frequency channel, B, and a single center channel signal, C. It can be appreciated by one of ordinary skill in the art that the concepts of the present invention are equally applicable to any multi-channel system of greater or fewer individual audio channels.

As will be explained in more detail in connection with FIGS. 3 and 4, the multi-channel immersion processor 24 modifies the output signals 22 received from the mixer 20 to create an immersive three-dimensional effect when a pair of output signals, $L_{out}$ and $R_{out}$, are acoustically reproduced. The processor 24 is shown in FIG. 1 as an analog processor operating in real time on the multi-channel mixed output signals 22. If the processor 24 is an analog device and if the audio source 16 provides a digital data output, then the processor 24 must of course include a digital-to-analog converter (not shown) before processing the signals 22.

Figure 2:
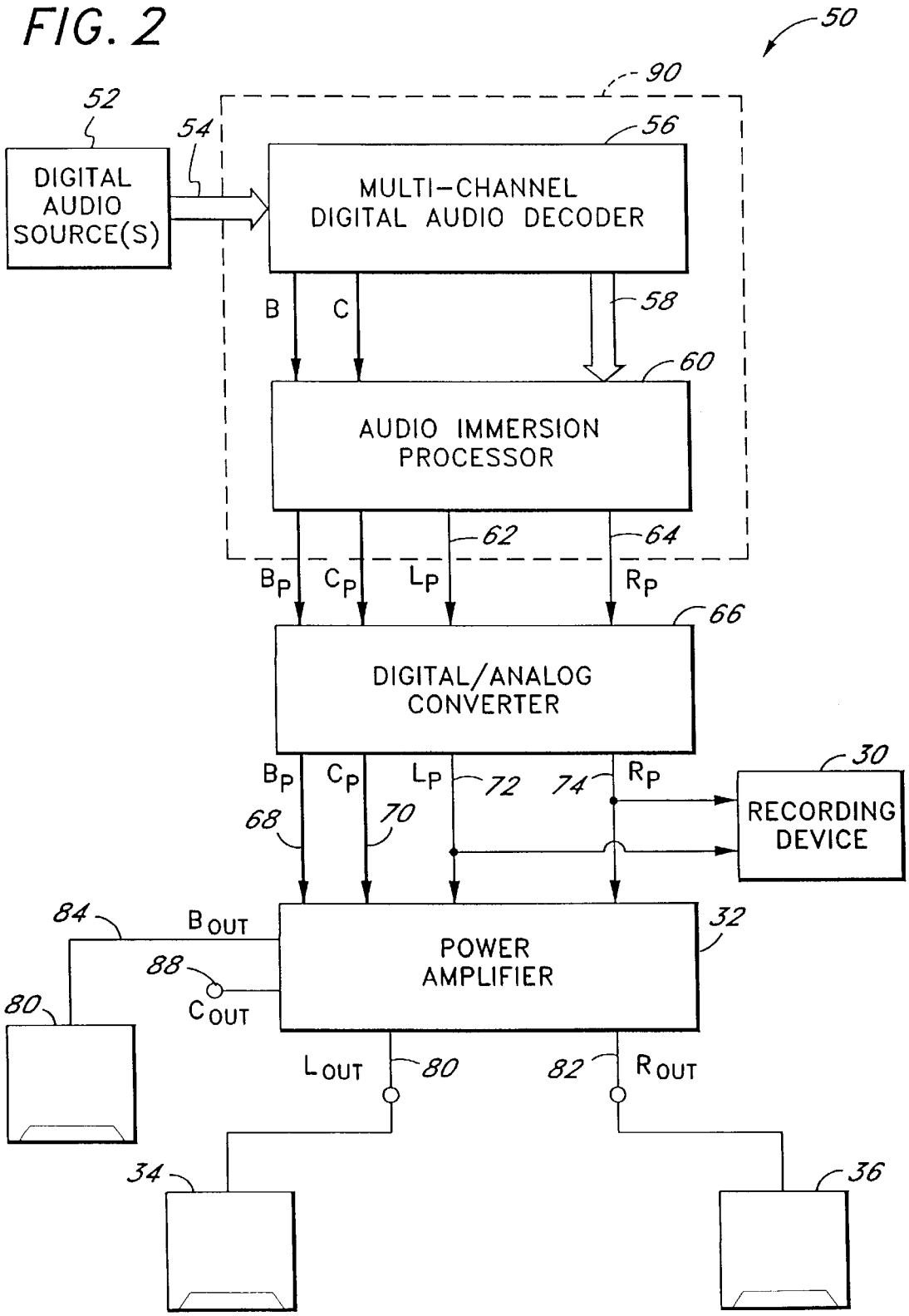
FIG. 2 is a schematic block diagram of a second embodiment of a multi-channel audio enhancement system for generating a pair of enhanced output signals to create a surround-sound effect.

Referring now to FIG. 2, a second preferred embodiment of a multi-channel audio enhancement system is shown which provides digital immersion processing of an audio source. An audio enhancement system 50 is shown comprising a digital audio source 52 which delivers audio information along a path 54 to a multi-channel digital audio decoder 56. The decoder 56 transmits multiple audio channel signals along a path 58. In addition, optional bass and center signals B and C may be generated by the decoder 56. Digital data signals 58, B, and C, are transmitted to an audio immersion processor 60 operating digitally to enhance the received signals. The processor 60 generates a pair of enhanced digital signals 62 and 64 which are fed to a digital to analog converter 66. In addition, the signals B and C are fed to the converter 66. The resultant enhanced analog signals 68 and 70, corresponding to the low frequency and center information, are fed to the power amplifier 32. Similarly, the enhanced analog left and right signals, 72, 74, are delivered to the amplifier 32. The left and right enhanced signals 72 and 74 may be diverted to a recording device 30 for storing the processed signals 72 and 74 directly on a recording medium such as magnetic tape or an optical disk. Once stored on recorded media, the processed audio information corresponding to signals 72 and 74 may be reproduced by a conventional stereo system without further enhancement processing to achieve the intended immersive effect described herein.

The amplifier 32 delivers an amplified left output signal 80, $L_{OUT}$, to the left speaker 34 and delivers an amplified right output signal 82, $R_{OUT}$, to the right speaker 36. Also, an amplified bass effects signal 84, $B_{OUT}$, is delivered to a sub-woofer 86. An amplified center signal 88, $C_{OUT}$, may be delivered to an optional center speaker (not shown). For near field reproductions of the signals 80 and 82, i.e., where a listener is position close to and in between the speakers 34 and 36, use of a center speaker may not be necessary to achieve adequate localization of a center image. However, in far-field applications where listeners are positioned relatively far from the speakers 34 and 36, a center speaker can be used to fix a center image between the speaker 34 and 36.

The combination consisting largely of the decoder 56 and the processor 60 is represented by the dashed line 90 which may be implemented in any number of different ways depending on a particular application, design constraints, or mere personal preference. For example, the processing performed within the region 90 may be accomplished wholly within a digital signal processor (DSP), within software loaded into a computer's memory, or as part of a microprocessor's native signal processing capabilities such as that found in Intel's Pentium generation of micro-processors.

Figure 3:
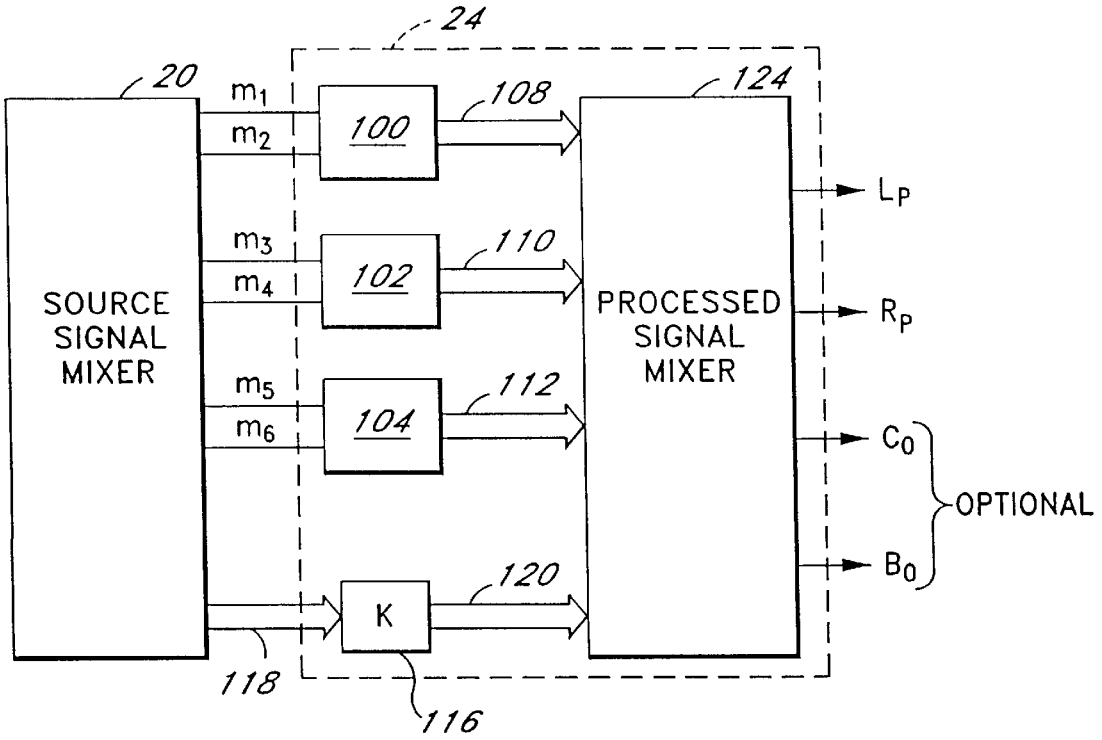
FIG. 3 is a schematic block diagram depicting an audio enhancement process for enhancing selected pairs of audio signals.

Referring now to FIG. 3, the immersion processor 24 from FIG. 1 is shown in association with the signal mixer 20. The processor 24 comprises individual enhancement modules 100, 102, and 104 which each receives a pair of audio signals from the mixer 20. The enhancement modules 100, 102, and 104 process a corresponding pair of signals on the stereo level in part by isolating ambient and monophonic components from each pair of signals. These components, along with the original signals are modified to generate resultant signals 108, 110, and 112. Bass, center and other signals which undergo individual processing are delivered along a path 118 to a module 116 which may provide level adjustment, simple filtering, or other modification of the received signals 118. The resultant signals 120 from the module 116, along with the signals 108, 110, and 112 are output to a mixer 124 within the processor 24.

Figure 4:
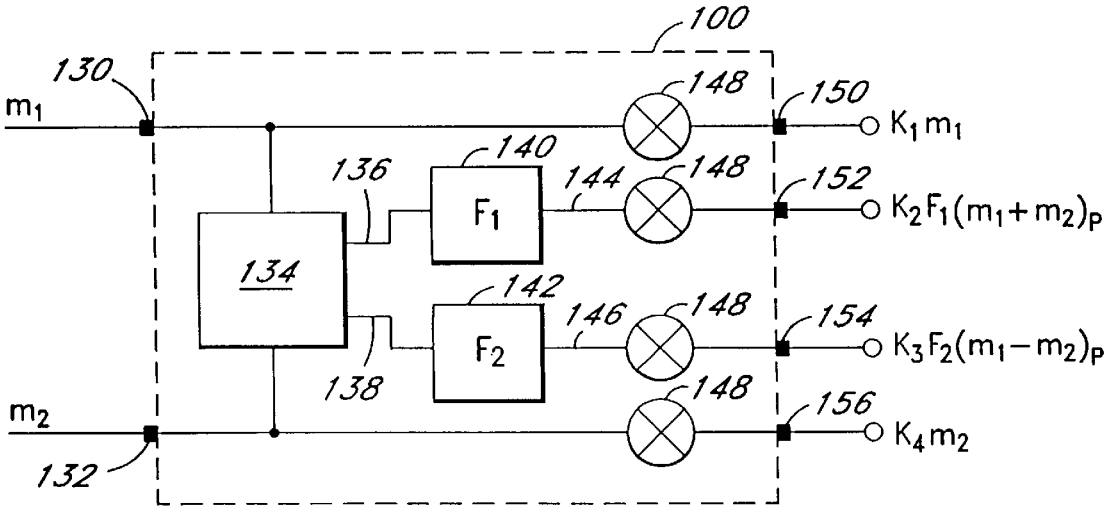
FIG. 4 is a schematic block diagram of an enhancement circuit for processing selected components from a pair of audio signals.

In FIG. 4, an exemplary internal configuration of a preferred embodiment for the module 100 is depicted. The module 100 consists of inputs 130 and 132 for receiving a pair of audio signals. The audio signals are transferred to a circuit or other processing means 134 for separating the ambient components from the direct field, or monophonic, sound components found in the input signals. In a preferred embodiment, the circuit 134 generates a direct sound component along a signal path 136 representing the summation signal $M_1+M_2$. A difference signal containing the ambient components of the input signals, $M_1-M_2$, is transferred along a path 138. The sum signal $M_1+M_2$ is modified by a circuit 140 having a transfer function $F_1$. Similarly, the difference signal $M_1-M_2$ is modified by a circuit 142 having a transfer function $F_2$. The transfer functions $F_1$ and $F_2$ may be identical and in a preferred embodiment provide spatial enhancement to the inputted signals by emphasizing certain frequencies while deemphasizing others. The transfer functions $F_1$ and $F_2$ may also apply HRTF-based processing to the inputted signals in order to achieve a perceived placement of the signals upon playback. If desired, the circuits 140 and 142 may be used to insert time delays or phase shifts of the input signals 136 and 138 with respect to the original signals $M_1$ and $M_2$.

The circuits 140 and 142 output a respective modified sum and difference signal, $(M_1+M_2)_P$ and $(M_1-M_2)_P$, along paths 144 and 146, respectively. The original input signals $M_1$ and $M_2$, as well as the processed signals $(M_1+M_2)_P$ and $(M_1-M_2)_P$ are fed to multipliers which adjust the gain of the received signals. After processing, the modified signals exit the enhancement module 100 at outputs 150, 152, 154, and 156. The output 150 delivers the signal $K_1M_1$, the output 152 delivers the signal $K_2F_1(M_1+M_2)$, the output 154 delivers the signal $K_3F_4(M_1-M_2)$, and the output 156 delivers the signal $K_4M_2$, where $K_1$–$K_4$ are constants determined by the setting of multipliers 148. The type of processing performed by the modules 100, 102, 104, and 116, and in particular the circuits 134, 140, and 142 may be user-adjustable to achieve a desired effect and/or a desired position of a reproduced sound. In some cases, it may be desirable to process only an ambient component or a monophonic component of a pair of input signals. The processing performed by each module may be distinct or it may be identical to one or more other modules.

In accordance with a preferred embodiment where a pair of audio signals is collectively enhanced before mixing, each module 100, 102, and 104 will generate four processed signals for receipt by the mixer 24 shown in FIG. 3. All of the signals 108, 110, 112, and 120 may be selectively combined by the mixer 124 in accordance with principles common to one of ordinary skill in the art and dependent upon a user's preferences.

By processing multi-channel signals at the stereo level, i.e., in pairs, subtle differences and similarities within the paired signals can be adjusted to achieve an immersive effect created upon playback through speakers. This immersive effect can be positioned by applying HRTF-based transfer functions to the processed signals to create a fully immersive positional sound field. Each pair of audio signals is separately processed to create a multi-channel audio mixing system that can effectively recreate the perception of a live 360 degree sound stage. Through separate HRTF processing of the components of a pair of audio signals, e.g., the ambient and monophonic components, more signal conditioning control is provided resulting in a more realistic immersive sound experience when the processed signals are acoustically reproduced. Examples of HRTF transfer functions which can be used to achieve a certain perceived azimuth are described in the article by E. A. B. Shaw entitled "Transformation of Sound Pressure Level From the Free Field to the Eardrum in the Horizontal Plane", J.Acoust.Soc.Am., Vol. 56, No. 6, December 1974, and in the article by S. Mehrgarat and V. Mellert entitled "Transformation Characteristics of the External Human Ear", J.Acoust.Soc.Am., Vol. 61, No. 6, June 1977, both of which are incorporated herein by reference as though fully set forth.

Although principles of the present invention as described above in connection with FIGS. 1–4 are suitable for use in professional recording studios to make high-quality recordings, one particular application of the present invention is in audio playback devices which have the capability to process but not reproduce multi-channel audio signals. For example, today's audio-visual recorded media are being encoded with multiple audio channel signals for reproduction in a home theater surround processing system. Such surround systems typically include forward or front speakers for reproducing left and right stereo signals, rear speakers for reproducing left surround and right surround signals, a center speaker for reproducing a center signal, and a sub-woofer speaker for reproduction of a low-frequency signal. Recorded media which can be played by such surround systems may be encoded with multi-channel audio signals through such techniques as Dolby's proprietary AC-3 audio encoding standard. Many of today's playback devices are not equipped with surround or center channel speakers. As a consequence, the full capability of the multi-channel recorded media may be left untapped leaving the user with an inferior listening experience.

Figure 5:
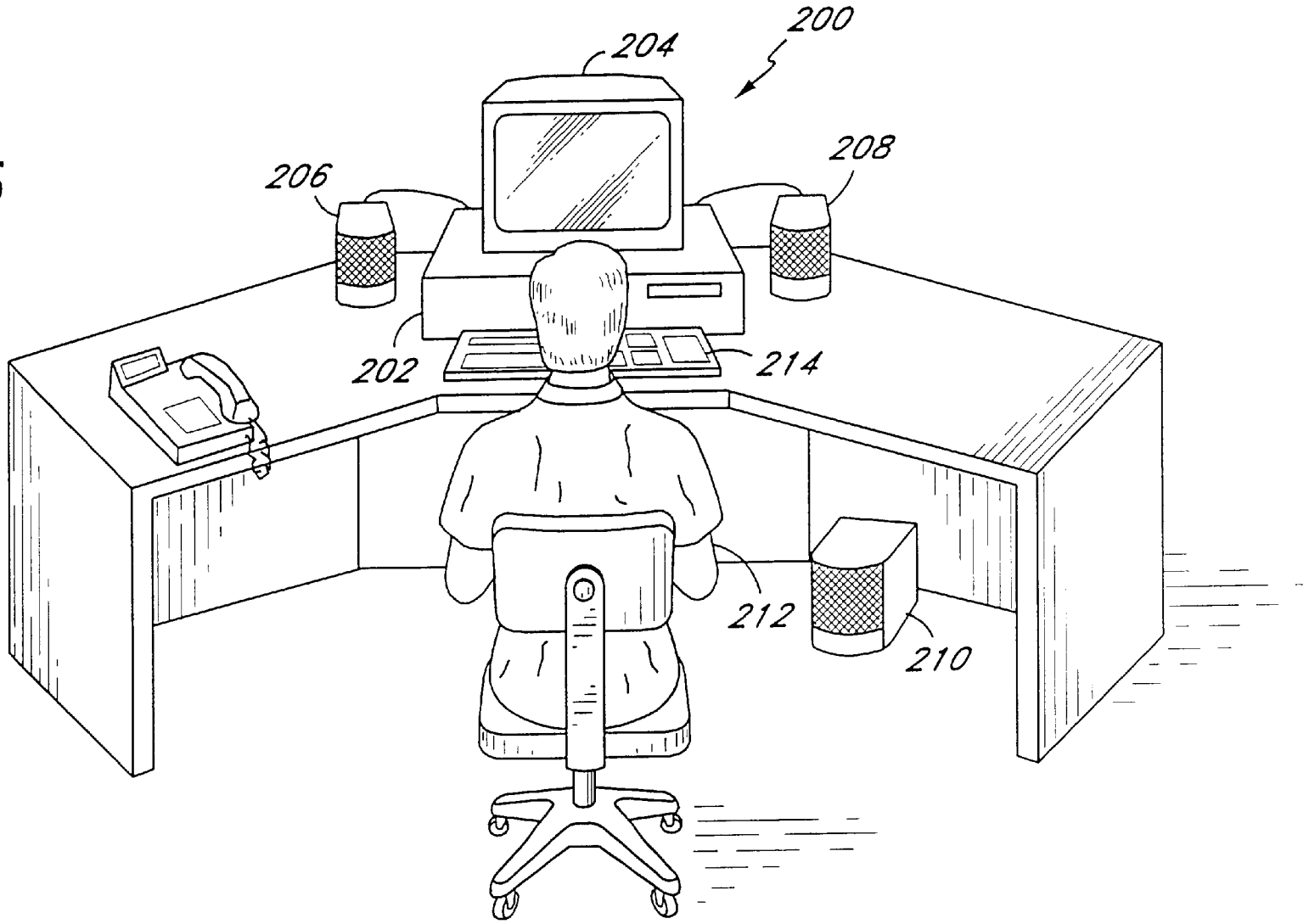
FIG. 5 is a perspective view of a personal computer having an audio enhancement system constructed in accordance with the present invention for creating a surround-sound effect from two output signals.

Referring now to FIG. 5, a personal computer system 200 is shown having an immersive positional audio processor constructed in accordance with the present invention. The computer system 200 consists of a processing unit 202 coupled to a display monitor 204. A front left speaker 206 and front right speaker 208, along with an optional sub-woofer speaker 210 are all connected to the unit 202 for reproducing audio signals generated by the unit 202. A listener 212 operates the computer system 200 via a keyboard 214. The computer system 200 processes a multi-channel audio signal to provide the listener 212 with an immersive 360 degree surround sound experience from just the speakers 206, 208 and the speaker 210 if available. In accordance with a preferred embodiment, the processing system disclosed herein will be described for use with Dolby AC-3 recorded media. It can be appreciated, however, that the same or similar principles may be applied to other standardized audio recording techniques which use multiple channels to create a surround sound experience. Moreover, while a computer system 200 is shown and described in FIG. 5, the audio-visual playback device for reproducing the AC-3 recorded media may be a television, a combination television/personal computer, a digital video disk player coupled to a television, or any other device capable of playing a multi-channel audio recording.

Figure 6:
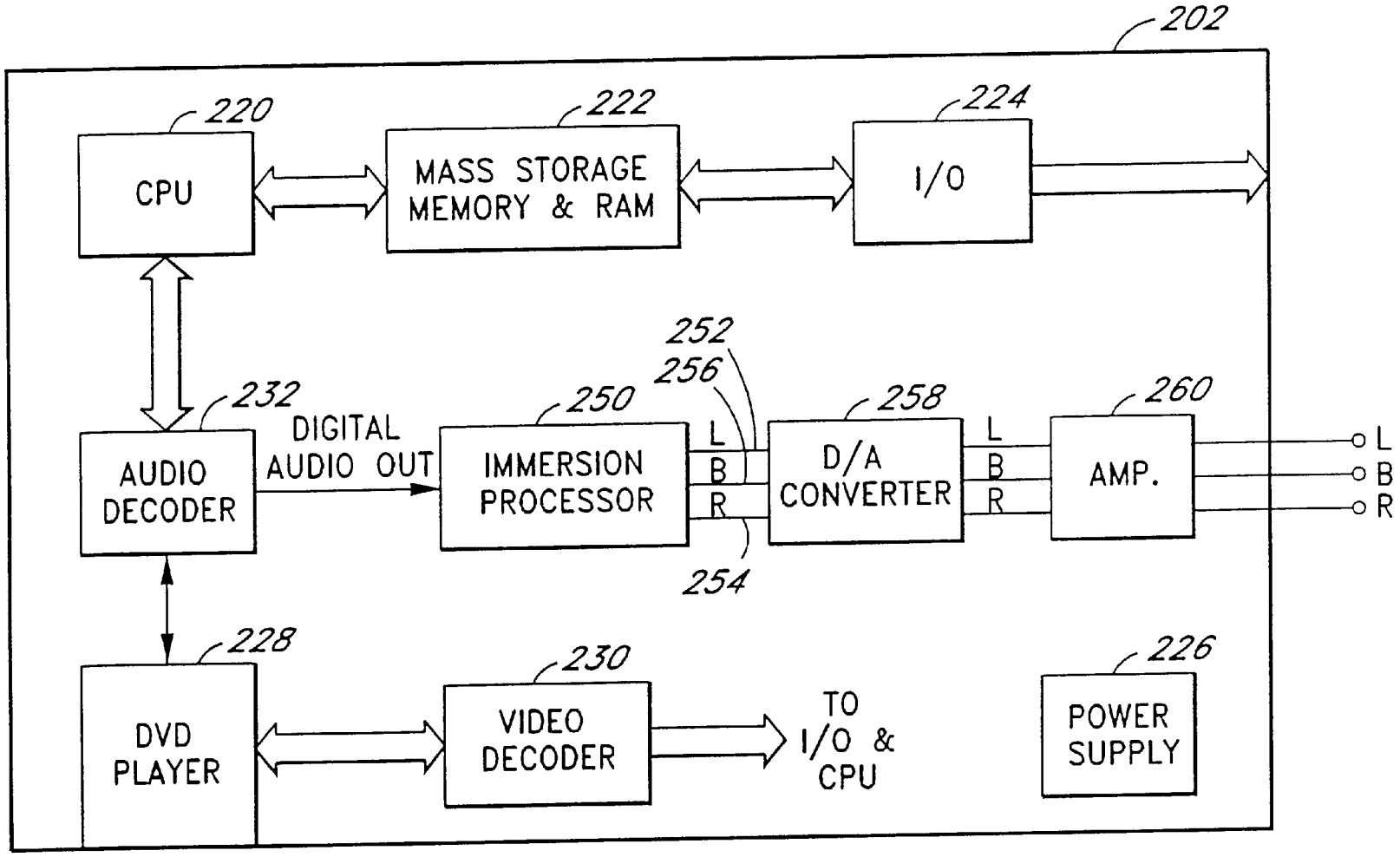
FIG. 6 is a schematic block diagram of the personal computer of FIG. 5 depicting major internal components thereof.

FIG. 6 is a schematic block diagram of the major internal components of the processing unit 202 of FIG. 5. The unit 202 contains the components of a typical personal computer system, constructed in accordance with principles common to one of ordinary skill, including a central processing unit (CPU) 220, a mass storage memory and a temporary random access memory (RAM) system 222, an input/output control device 224, all interconnected via an internal bus structure. The unit 202 also contains a power supply 226 and a recorded media player/recorder 228 which may be a DVD device or other multi-channel audio source. The DVD player 228 supplies video data to a video decoder 230 for display on a monitor. Audio data from the DVD player 228 is transferred to an audio decoder 232 which supplies multiple channel digital audio data from the player 228 to an immersion processor 250. The audio information from the decoder 232 contains a left front signal, a right front signal, a left surround signal, a right surround signal, a center signal, and a low-frequency signal, all of which are transferred to the immersion audio processor 250. The processor 250 digitally enhances the audio information from the decoder 232 in a manner suitable for playback with a conventional stereo playback system. Specifically, a left channel signal 252 and a right channel signal 254 are provided as outputs from the processor 250. A low-frequency sub-woofer signal 256 is also provided for delivery of bass response in a stereo playback system. The signals 252, 254, and 256 are first provided to a digital-to-analog converter 258, then to an amplifier 260, and then output for connection to corresponding speakers.

Figure 7:
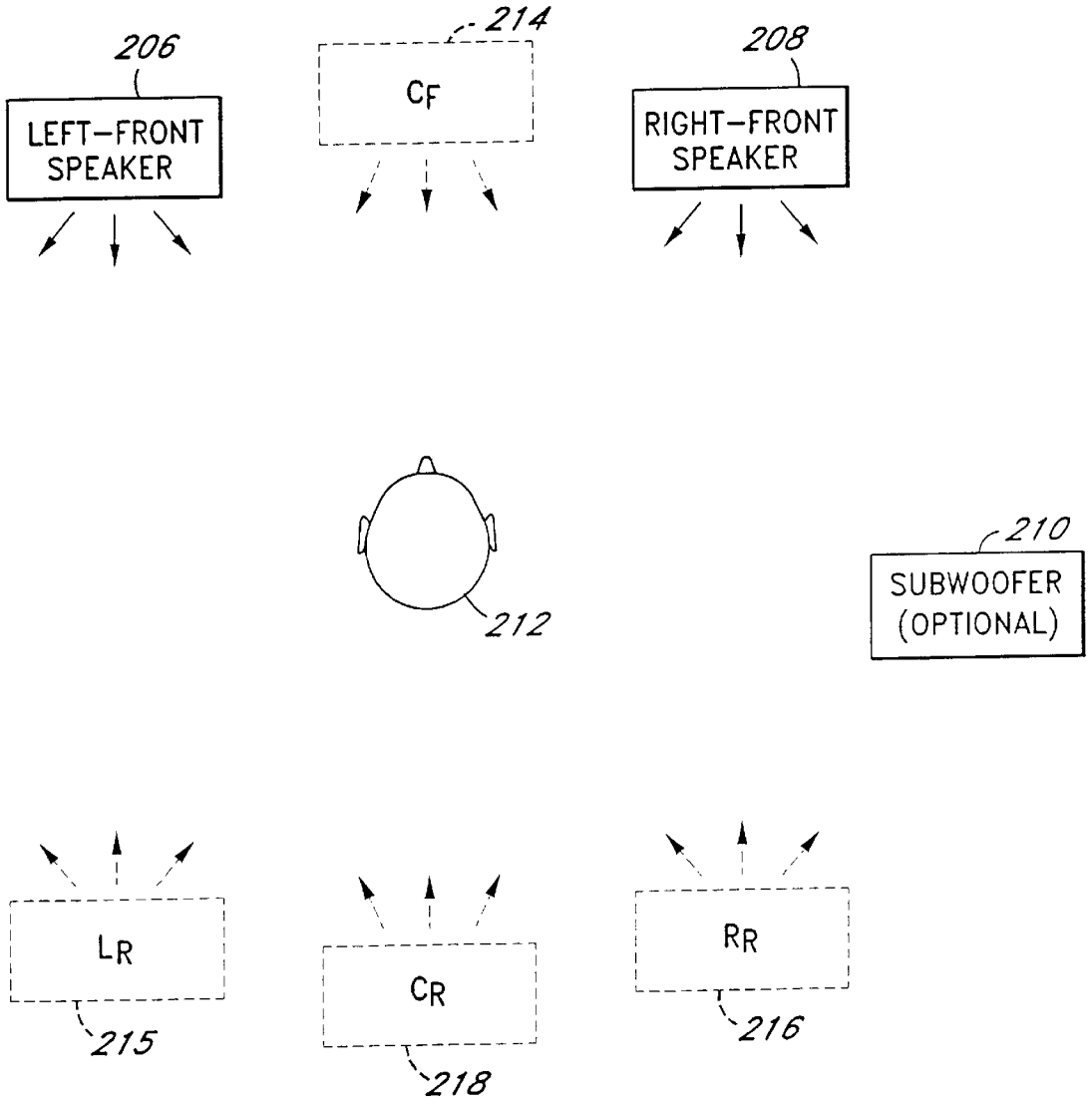
FIG. 7 is a diagram depicting the perceived and actual origins of sounds heard by a listener during operation of the personal computer shown in FIG. 5.

Referring now to FIG. 7, a schematic representation of speaker locations of the system of FIG. 5 is shown from an overhead perspective. The listener 212 is positioned in front of and between the left front speaker 206 and the right front speaker 208. Through processing of surround signals generated from an AC-3 compatible recording in accordance with a preferred embodiment, a simulated surround experience is created for the listener 212. In particular, ordinary playback of two channel signals through the speakers 206 and 208 will create a perceived phantom center speaker 214 from which monophonic components of left and right signals will appear to emanate. Thus, the left and right signals from an AC-3 six channel recording will produce the center phantom speaker 214 when reproduced through the speakers 206 and 208. The left and right surround channels of the AC-3 six channel recording are processed so that ambient surround sounds are perceived as emanating from rear phantom speakers 215 and 216 while monophonic surround sounds appear to emanate from a rear phantom center speaker 218. Furthermore, both the left and right front signals, and the left and right surround signals, are spatially enhanced to provide an immersive sound experience to eliminate the actual speakers 206, 208 and the phantom speakers 215, 216, and 218, as perceived point sources of sound. Finally, the low-frequency information is reproduced by an optional sub-woofer speaker 210 which may be placed at any location about the listener 212.

Figure 8:
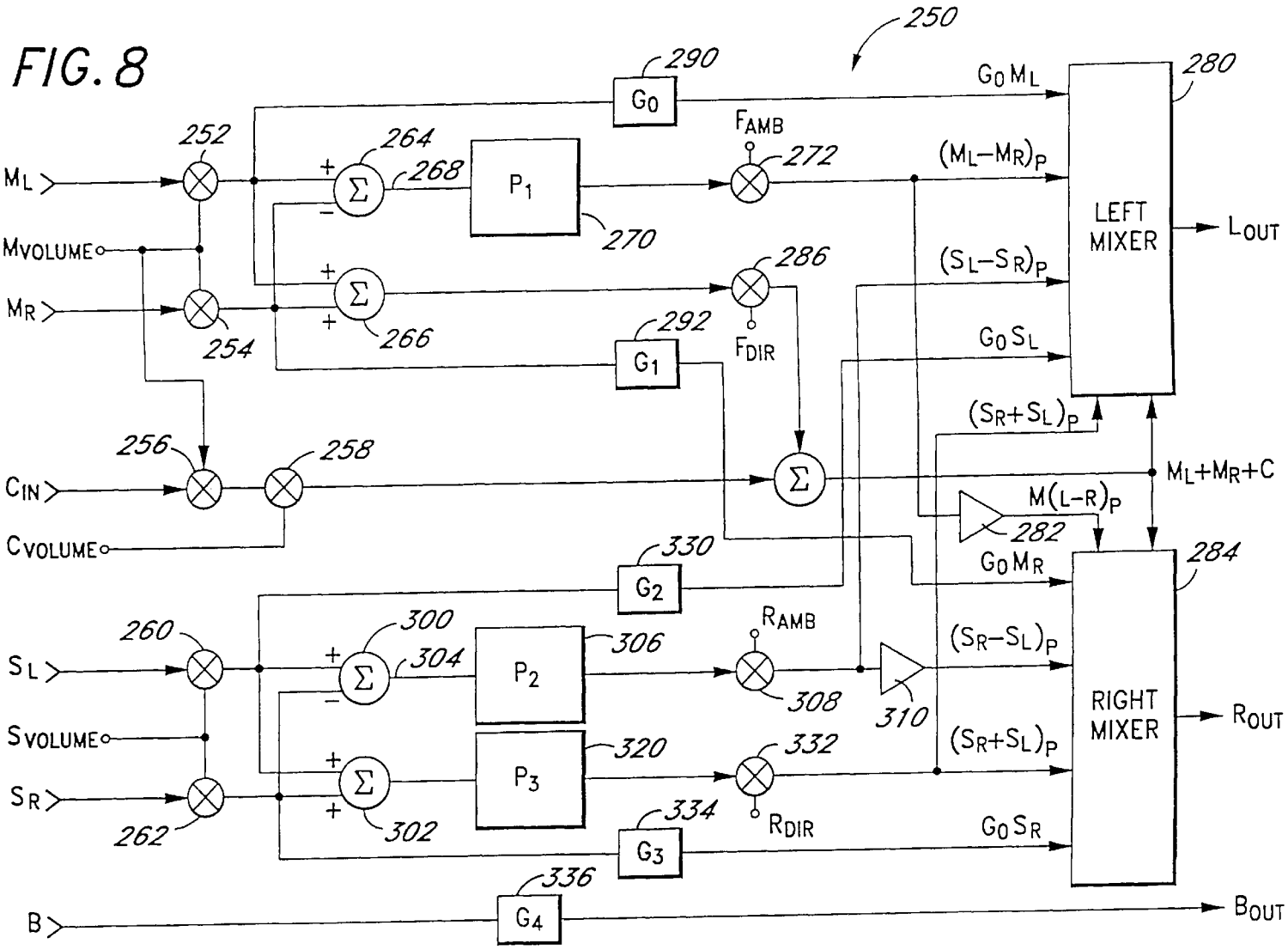
FIG. 8 is a schematic block diagram of a preferred embodiment for processing and mixing a group of AC-3 audio signals to achieve a surround-sound experience from a pair of output signals.

FIG. 8 is a schematic representation of an immersive processor and mixer for achieving a perceived immersive surround effect shown in FIG. 7. The processor 250 corresponds to that shown in FIG. 6 and receives six audio channel signals consisting of a front main left signal $M_L$, a front main right signal $M_R$, a left surround signal $S_L$, a right surround signal $S_R$, a center channel signal C, and a low-frequency effects signal B. The signals $M_L$ and $M_R$ are fed to corresponding gain-adjusting multipliers 252 and 254 which are controlled by a volume adjustment signal $M_{volume}$. The gain of the center signal C may be adjusted by a first multiplier 256, controlled by the signal $M_{volume}$, and a second multiplier 258 controlled by a center adjustment signal $C_{volume}$. Similarly, the surround signals $S_L$ and $S_R$ are first fed to respective multipliers 260 and 262 which are controlled by a volume adjustment signal $S_{volume}$.

The main front left and right signals, $M_L$ and $M_R$, are each fed to summing junctions 264 and 266. The summing junction 264 has an inverting input which receives $M_R$ and a non-inverting input which receives $M_L$ which combine to produce $M_L-M_R$ along an output path 268. The signal $M_L-M_R$ is fed to an enhancement circuit 270 which is characterized by a transfer function $P_1$. A processed difference signal, $(M_L-M_R)_P$, is delivered at an output of the circuit 270 to a gain adjusting multiplier 272. The output of the multiplier 272 is fed directly to a left mixer 280 and to an inverter 282. The inverted difference signal $(M_R-M_L)_P$ is transmitted from the inverter 282 to a right mixer 284. A summation signal $M_L+M_R$ exits the junction 266 and is fed to a gain adjusting multiplier 286. The output of the multiplier 286 is fed to a summing junction which adds the center channel signal, C, with the signal $M_L+M_R$. The combined signal, $M_L+M_R+C$, exits the junction 290 and is directed to both the left mixer 280 and the right mixer 284. Finally, the original signals $M_L$ and $M_R$ are first fed through fixed gain adjustment circuits, i.e., amplifiers, 290 and 292, respectively, before transmission to the mixers 280 and 284.

The surround left and right signals, $S_L$ and $S_R$, exit the multipliers 260 and 262, respectively, and are each fed to summing junctions 300 and 302. The summing junction 300 has an inverting input which receives $S_R$ and a non-inverting input which receives $S_L$ which combine to produce $S_L-S_R$ along an output path 304. All of the summing junctions 264, 266, 300, and 302 may be configured as either an inverting amplifier or a non-inverting amplifier, depending on whether a sum or difference signal is generated. Both inverting and non-inverting amplifiers may be constructed from ordinary operational amplifiers in accordance with principles common to one of ordinary skill in the art. The signal $S_L-S_R$ is fed to an enhancement circuit 306 which is characterized by a transfer function $P_2$. A processed difference signal, $(S_L-S_R)_P$, is delivered at an output of the circuit 306 to a gain adjusting multiplier 308. The output of the multiplier 308 is fed directly to the left mixer 280 and to an inverter 310. The inverted difference signal $(S_R-S_L)_P$ is transmitted from the inverter 310 to the right mixer 284. A summation signal $S_L+S_R$ exits the junction 302 and is fed to a separate enhancement circuit 320 which is characterized by a transfer function $P_3$. A processed summation signal, $(S_L+S_R)_P$, is delivered at an output of the circuit 320 to a gain adjusting multiplier 332. While reference is made to sum and difference signals, it should be noted that use of actual sum and difference signals is only representative. The same processing can be achieved regardless of how the ambient and monophonic components of a pair of signals are isolated. The output of the multiplier 332 is fed directly to the left mixer 280 and to the right mixer 284. Also, the original signals $S_L$ and $S_R$ are first fed through fixed-gain amplifiers 330 and 334, respectively, before transmission to the mixers 280 and 284. Finally, the low-frequency effects channel, B, is fed through an amplifier 336 to create the output low-frequency effects signal, $B_{OUT}$. Optionally, the low frequency channel, B, may be mixed as part of the output signals, $L_{OUT}$ and $R_{OUT}$, if no subwoofer is available.

The enhancement circuit 250 of FIG. 8 may be implemented in an analog discrete form, in a semiconductor substrate, through software run on a main or dedicated microprocessor, within a digital signal processing (DSP) chip, i.e., firmware, or in some other digital format. It is also possible to use a hybrid circuit structure combing both analog and digital components since in many cases the source signals will be digital. Accordingly, an individual amplifier, an equalizer, or other components, may be realized by software or firmware. Moreover, the enhancement circuit 270 of FIG. 8, as well as the enhancement circuits 306 and 320, may employ a variety of audio enhancement techniques. For example, the circuit devices 270, 306, and 320 may use time-delay techniques, phase-shift techniques, signal equalization, or a combination of all of these techniques to achieve a desired audio effect. The basic principles of such audio enhancement techniques are common to one of ordinary skill in the art.

In a preferred embodiment, the immersion processor circuit 250 uniquely conditions a set of AC-3 multi-channel signals to provide a surround sound experience through playback of the two output signals $L_{OUT}$ and $R_{OUT}$. Specifically, the signals $M_L$ and $M_R$ are processed collectively by isolating the ambient information present in these signals. The ambient signal component represents the differences between a pair of audio signals. An ambient signal component derived from a pair of audio signals is therefore often referred to as the "difference" signal component. While the circuits 270, 306, and 320 are shown and described as generating sum and difference signals, other embodiments of audio enhancement circuits 270, 306, and 320 may not distinctly generate sum and difference signals at all. This can be accomplished in any number of ways using ordinary circuit design principles. For example, the isolation of the difference signal information and its subsequent equalization may be performed digitally, or performed simultaneously at the input stage of an amplifier circuit. In addition to processing of AC-3 audio signal sources, the circuit 250 of FIG. 8 will automatically process signal sources having fewer discrete audio channels. For example, if Dolby Pro-Logic signals are input by the processor 250, i.e., where $S_L=S_R$, only the enhancement circuit 320 will operate to modify the rear channel signals since no ambient component will be generated at the junction 300. Similarly, if only two-channel stereo signals, $M_L$ and $M_R$, are present, then the processor 250 operates to create a spatially enhanced listening experience from only two channels through operation of the enhancement circuit 270.

Figure 9:
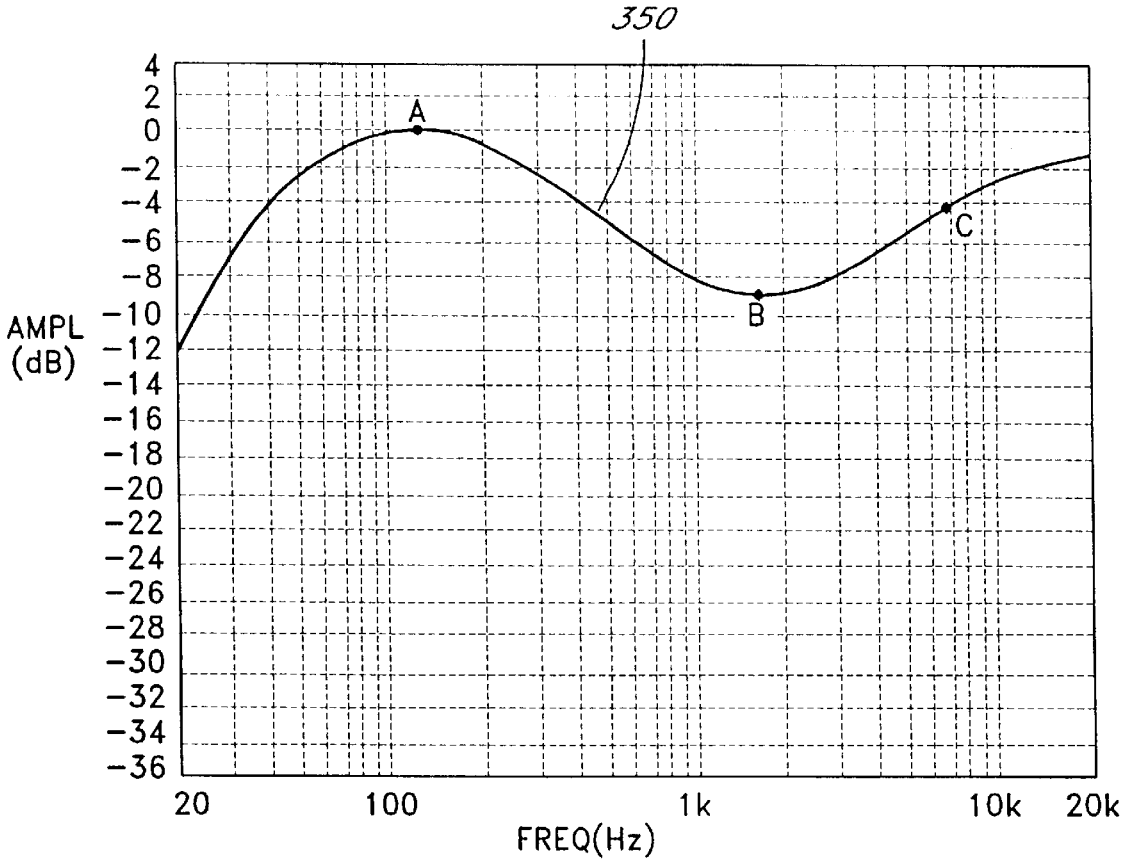
FIG. 9 is a graphical representation of a first signal equalization curve for use in a preferred embodiment for processing and mixing a group of AC-3 audio signals to achieve a surround-sound experience from a pair of output signals.

In accordance with a preferred embodiment, the ambient information of the front channel signals, which can be represented by the difference $M_L-M_R$, is equalized by the circuit 270 according to the frequency response curve 350 of FIG. 9. The curve 350 can be referred to as a spatial correction, or "perspective", curve. Such equalization of the ambient signal information broadens and blends a perceived sound stage generated from a pair of audio signals by selectively enhancing the sound information that provides a sense of spaciousness.

The enhancement circuits 306 and 320 modify the ambient and monophonic components, respectively, of the surround signals $S_L$ and $S_R$. In accordance with a preferred embodiment, the transfer functions $P_2$ and $P_3$ are equal and both apply the same level of perspective equalization to the corresponding input signal. In particular, the circuit 306 equalizes an ambient component of the surround signals, represented by the signal $S_L-S_R$, while the circuit 320 equalizes an monophonic component of the surround signals, represented by the signal $S_L+S_R$. The level of equalization is represented by the frequency response curve 352 of FIG. 10.

Figure 10:
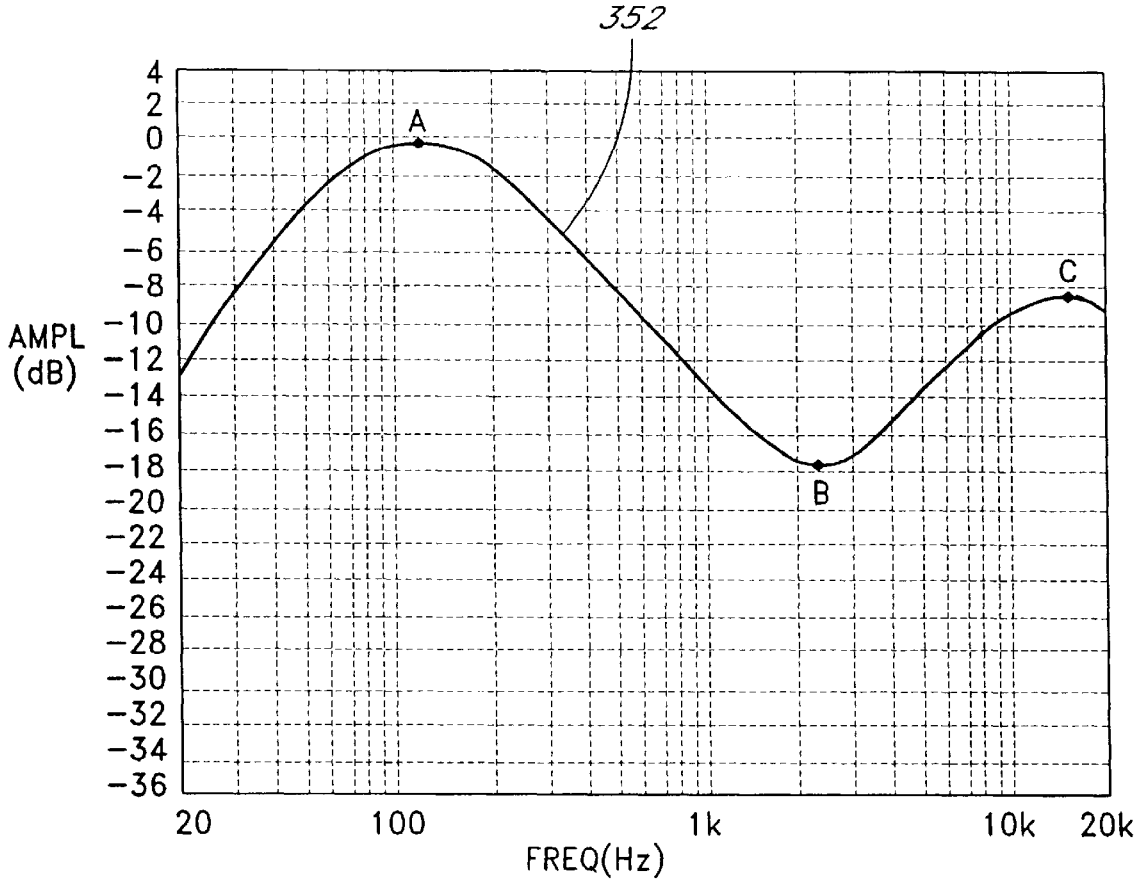
FIG. 10 is a graphical representation of a second signal equalization curve for use in a preferred embodiment for processing and mixing a group of AC-3 audio signals to achieve a surround-sound experience from a pair of output signals.

The perspective equalization curves 350 and 352 are displayed in FIGS. 9 and 10, respectively, as a function of gain, measured in decibels, against audible frequencies displayed in log format. The gain level in decibels at individual frequencies are only relevant as they relate to a reference signal since final amplification of the overall output signals occurs in the final mixing process. Referring initially to FIG. 9, and according to a preferred embodiment, the perspective curve 350 has a peak gain at a point A located at approximately 125 Hz. The gain of the perspective curve 350 decreases above and below 125 Hz at a rate of approximately 6 dB per octave. The perspective curve 350 reaches a minimum gain at a point B within a range of approximately 1.5–2.5 kHz. The gain increases at frequencies above point B at a rate of approximately 6 dB per octave up to a point C at approximately 7 kHz, and then continues to increase up to approximately 20 kHz, i.e., approximately the highest frequency audible to the human ear.

Referring now to FIG. 10, and according to a preferred embodiment, the perspective curve 352 has a peak gain at a point A located at approximately 125 Hz. The gain of the perspective curve 350 decreases below 125 Hz at a rate of approximately 6 dB per octave and decreases above 125 Hz at a rate of approximately 6 dB per octave. The perspective curve 352 reaches a minimum gain at a point B within a range of approximately 1.5–2.5 kHz. The gain increases at frequencies above point B at a rate of approximately 6 dB per octave up to a maximum-gain point C at approximately 10.5–11.5 kHz. The frequency response of the curve 352 decreases at frequencies above approximately 11.5 kHz.

Apparatus and methods suitable for implementing the equalization curves 350 and 352 of FIGS. 9 and 10 are similar to those disclosed in pending application Ser. No. 08/430751 filed on Apr. 27, 1995, which is incorporated herein by reference as though fully set forth. Related audio enhancement techniques for enhancing ambient information are disclosed in U.S. Pat. Nos. 4,738,669 and 4,866,744, issued to Arnold I. Klayman, both of which are also incorporated by reference as though fully set forth herein.

In operation, the circuit 250 of FIG. 8 uniquely functions to position the five main channel signals, $M_L$, $M_R$, C, $S_R$, and $S_L$ about a listener upon reproduction by only two speakers. As discussed previously, the curve 350 of FIG. 9 applied to the signal $M_L-M_R$ broadens and spatially enhances ambient sounds from the signals $M_L$ and $M_R$. This creates the perception of a wide forward sound stage emanating from the speakers 206 and 208 shown in FIG. 7. This is accomplished through selective equalization of the ambient signal information to emphasize the low and high frequency components. Similarly, the equalization curve 352 of FIG. 10 is applied to the signal $S_L-S_R$ to broaden and spatially enhance the ambient sounds from the signals $S_L$ and $S_R$. In addition, however, the equalization curve 352 modifies the signal $S_L-S_R$ to account for HRTF positioning to obtain the perception of rear speakers 215 and 216 of FIG. 7. As a result, the curve 352 contains a higher level of emphasis of the low and high frequency components of the signal $S_L-S_R$ with respect to that applied to $M_L-M_R$. This is required since the normal frequency response of the human ear for sounds directed at a listener from zero degrees azimuth will emphasize sounds centered around approximately 2.75 kHz. The emphasis of these sounds results from the inherent transfer function of the average human pinna and from ear canal resonance. The perspective curve 352 of FIG. 10 counteracts the inherent transfer function of the ear to create the perception of rear speakers for the signals $S_L-S_R$ and $S_L+S_R$. The resultant processed difference signal $(S_L-S_R)_P$ is driven out of phase to the corresponding mixers 280 and 284 to maintain the perception of a broad rear sound stage as if reproduced by phantom speakers 215 and 216.

By separating the surround signal processing into sum and difference components, greater control is provided by allowing the gain of each signal, $S_L-S_R$ and $S_L+S_R$, to be adjusted separately. The present invention also recognizes that creation of a center rear phantom speaker 218, as shown in FIG. 7, requires similar processing of the sum signal $S_L+S_R$ since the sounds actually emanate from forward speakers 206 and 208. Accordingly, the signal $S_L+S_R$ is also equalized by the circuit 320 according to the curve 352 of FIG. 10. The resultant processed signal $(S_L+S_R)_P$ is driven in-phase to achieve the perceived phantom speaker 218 as if the two phantom rear speakers 215 and 216 actually existed. For audio reproduction systems which include a dedicated center channel speaker, the circuit 250 of FIG. 8 can be modified so that the center signal C is fed directly to such center speaker instead of being mixed at the mixers 280 and 284.

The approximate relative gain values of the various signals within the circuit 250 can be measured against a 0 dB reference for the difference signals exiting the multipliers 272 and 308. With such a reference, the gain of the amplifiers 290, 292, 330, and 334 in accordance with a preferred embodiment is approximately −18 dB, the gain of the sum signal exiting the amplifier 332 is approximately −20 dB, the gain of the sum signal exiting the amplifier 286 is approximately −20 dB, and the gain of the center channel signal exiting the amplifier 258 is approximately −7 dB. These relative gain values are purely design choices based upon user preferences and may be varied without departing from the spirit of the invention. Adjustment of the multipliers 272, 286, 308, and 332 allows the processed signals to be tailored to the type of sound reproduced and tailored to a user's personal preferences. An increase in the level of a sum signal emphasizes the audio signals appearing at a center stage positioned between a pair of speakers. Conversely, an increase in the level of a difference signal emphasizes the ambient sound information creating the perception of a wider sound image. In some audio arrangements where the parameters of music type and system configuration are known, or where manual adjustment is not practical, the multipliers 272, 286, 308, and 332 may be preset and fixed at desired levels. In fact, if the level adjustment of multipliers 308 and 332 are desirably with the rear signal input levels, then it is possible to connect the enhancement circuits directly to the input signals $S_L$ and $S_R$. As can be appreciated by one of ordinary skill in the art, the final ratio of individual signal strength for the various signals of FIG. 8 is also affected by the volume adjustments and the level of mixing applied by the mixers 280 and 284.

Accordingly, the audio output signals $L_{OUT}$ and $R_{OUT}$ produce a much improved audio effect because ambient sounds are selectively emphasized to fully encompass a listener within a reproduced sound stage. Ignoring the relative gains of the individual components, the audio output signals $L_{OUT}$ and $R_{OUT}$ are represented by the following mathematical formulas:

$$L_{OUT}=M_L+S_L+(M_L-M_R)_P+(S_L-S_R)_P+(M_L+M_R+C)+(S_L+S_R)_P \quad (1)$$

$$R_{OUT}=M_R+S_R+(M_R-M_L)_P+(S_R-S_L)_P+(M_L+M_R+C)+(S_L+S_R)_P \quad (2)$$

The enhanced output signals represented above may be magnetically or electronically stored on various recording media, such as vinyl records, compact discs, digital or analog audio tape, or computer data storage media. Enhanced audio output signals which have been stored may then be reproduced by a conventional stereo reproduction system to achieve the same level of stereo image enhancement.

Figure 11:
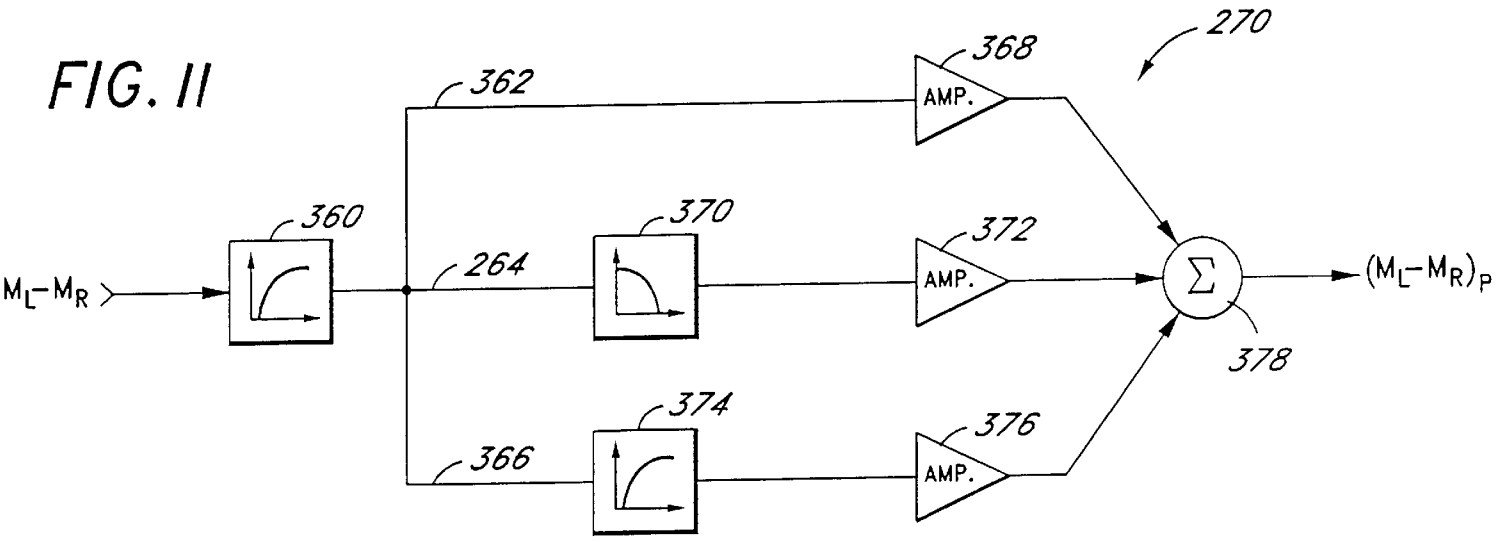
FIG. 11 is a schematic block diagram depicting the various filter and amplification stages for creating the first signal equalization curve of FIG. 9.

Referring to FIG. 11, a schematic block diagram is shown of a circuit for implementing the equalization curve 350 of FIG. 9 in accordance with a preferred embodiment. The circuit 270 inputs the ambient signal $M_L-M_R$, corresponding to that found at path 268 of FIG. 8. The signal $M_L-M_R$ is first conditioned by a high-pass filter 360 having a cutoff frequency, or −3 dB frequency, of approximately 50 Hz. Use of the filter 360 is designed to avoid over-amplification of the bass components present in the signal $M_L-M_R$.

The output of the filter 360 is split into three separate signal paths 362, 364, and 366 in order to spectrally shape the signal $M_L-M_R$. Specifically, $M_L-M_R$ is transmitted along the path 362 to an amplifier 368 and then on to a summing junction 378. The signal $M_L-M_R$ is also transmitted along the path 364 to a low-pass filter 370, then to an amplifier 372, and finally to the summing junction 378. Lastly, the signal $M_L-M_R$ is transmitted along the path 366 to a high-pass filter 374, then to an amplifier 376, and then to the summing junction 378. Each of the separately conditioned signals $M_L-M_R$ are combined at the summing junction 378 to create the processed difference signal $(M_L-M_R)_P$. In a preferred embodiment, the low-pass filter 370 has a cutoff frequency of approximately 200 Hz while the high-pass filter 374 has a cutoff frequency of approximately 7 kHz. The exact cutoff frequencies are not critical so long as the ambient components in a low and high frequency range, relative to those in a mid-frequency range of approximately 1 to 3 kHz, are amplified. The filters 360, 370, and 374 are all first order filters to reduce complexity and cost but may conceivably be higher order filters if the level of processing, represented in FIGS. 9 and 10, is not significantly altered. Also in accordance with a preferred embodiment, the amplifier 368 will have an approximate gain of one-half, the amplifier 372 will have a gain of approximately 1.4, and the amplifier 376 will have an approximate gain of unity.

The signals which exit the amplifiers 368, 372, and 376 make up the components of the signal $(M_L-M_R)_P$. The overall spectral shaping, i.e., normalization, of the ambient signal $M_L-M_R$ occurs as the summing junction 378 combines these signals. It is the processed signal $(M_L-M_R)_P$ which is mixed by the left mixer 280 (shown in FIG. 8) as part of the output signal $L_{OUT}$. Similarly, the inverted signal $(M_R-M_L)_P$ is mixed by the right mixer 284 (shown in FIG. 8) as part of the output signal $R_{OUT}$.

Referring again to FIG. 9, in a preferred embodiment, the gain separation between points A and B of the perspective curve 350 is ideally designed to be 9 dB, and the gain separation between points B and C should be approximately 6 dB. These figures are design constraints and the actual figures will likely vary depending on the actual value of components used for the circuit 270. If the gain of the amplifiers 368, 372, and 376 of FIG. 11 are fixed, then the perspective curve 350 will remain constant. Adjustment of the amplifier 368 will tend to adjust the amplitude level of point B thus varying the gain separation between points A and B, and points B and C. In a surround sound environment, a gain separation much larger than 9 dB may tend to reduce a listener's perception of mid-range definition.

Implementation of the perspective curve by a digital signal processor will, in most cases, more accurately reflect the design constraints discussed above. For an analog implementation, it is acceptable if the frequencies corresponding to points A, B, and C, and the constraints on gain separation, vary by plus or minus 20 percent. Such deviation from the ideal specifications will still produce the desired enhancement effect, although with less than optimum results.

Figure 12:
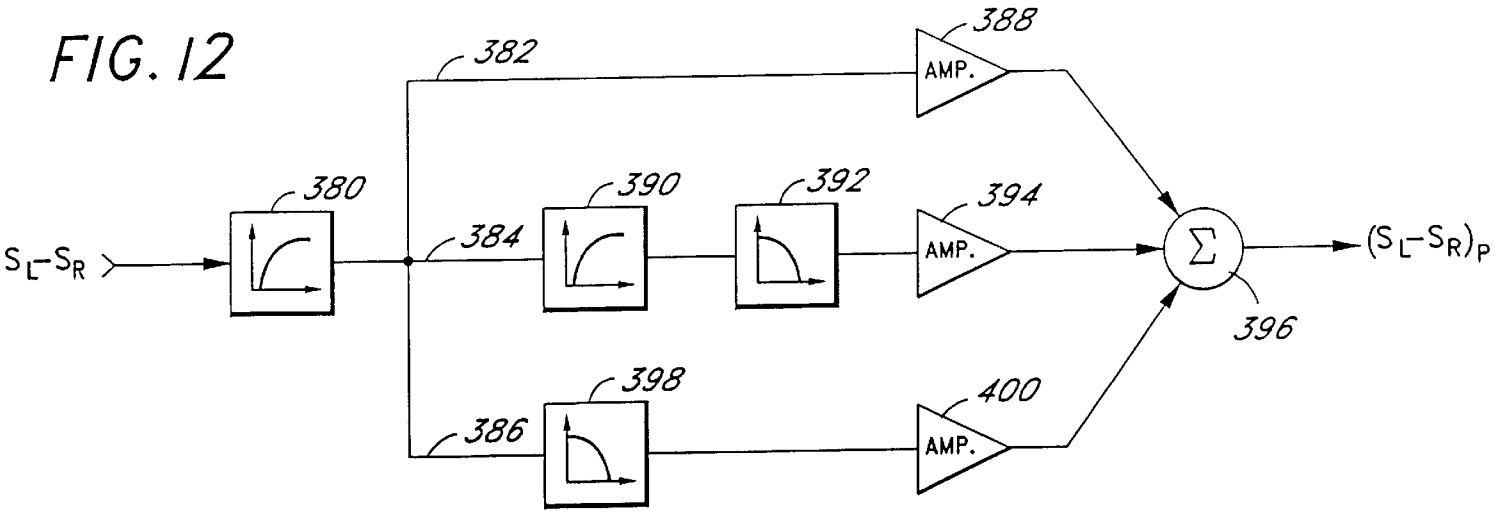
FIG. 12 is a schematic block diagram depicting the various filter and amplification stages for creating the second signal equalization curve of FIG. 10.

Referring now to FIG. 12, a schematic block diagram is shown of a circuit for implementing the equalization curve 352 of FIG. 10 in accordance with a preferred embodiment. Although the same curve 352 is used to shape the signals $S_L-S_R$ and $S_L+S_R$, for ease of discussion purposes, reference is made in FIG. 12 only to the circuit enhancement device 306. In a preferred embodiment, the characteristics of the device 306 is identical to that of 320. The circuit 306 inputs the ambient signal $S_L-S_R$, corresponding to that found at path 304 of FIG. 8. The signal $S_L-S_R$ is first conditioned by a high-pass filter 380 having a cutoff frequency of approximately 50 Hz. As in the circuit 270 of FIG. 11, the output of the filter 380 is split into three separate signal paths 382, 384, and 386 in order to spectrally shape the signal $S_L-S_R$. Specifically, the signal $S_L-S_R$ is transmitted along the path 382 to an amplifier 388 and then on to a summing junction 396. The signal $S_L-S_R$ is also transmitted along the path 384 to a high-pass filter 390 and then to a low-pass filter 392. The output of the filter 392 is transmitted to an amplifier 394, and finally to the summing junction 396. Lastly, the signal $S_L-S_R$ is transmitted along the path 386 to a low-pass filter 398, then to an amplifier 400, and then to the summing junction 396. Each of the separately conditioned signals $S_L-S_R$ are combined at the summing junction 396 to create the processed difference signal $(S_L-S_R)_P$. In a preferred embodiment, the high-pass filter 370 has a cutoff frequency of approximately 21 kHz while the low-pass filter 392 has a cutoff frequency of approximately 8 kHz. The filter 392 serves to create the maximum-gain point C of FIG. 10 and may be removed if desired. Additionally, the low-pass filter 398 has a cutoff frequency of approximately 225 Hz. As can be appreciated by one of ordinary skill in the art, there are many additional filter combinations which can achieve the frequency response curve 352 shown in FIG. 10 without departing from the spirit of the invention. For example, the exact number of filters and the cutoff frequencies are not critical so long as the signal $S_L-S_R$ is equalized in accordance with FIG. 10. In a preferred embodiment, all of the filters 380, 390, 392, and 398 are first order filters. Also in accordance with a preferred embodiment, the amplifier 388 will have an approximate gain of 0.1, the amplifier 394 will have a gain of approximately 1.8, and the amplifier 400 will have an approximate gain of 0.8. It is the processed signal $(S_L-S_R)_P$ which is mixed by the left mixer 280 (shown in FIG. 8) as part of the output signal $L_{OUT}$. Similarly, the inverted signal $(S_R-S_L)_P$ is mixed by the right mixer 284 (shown in FIG. 8) as part of the output signal $R_{OUT}$.

Referring again to FIG. 10, in a preferred embodiment, the gain separation between points A and B of the perspective curve 352 is ideally designed to be 18 dB, and the gain separation between points B and C should be approximately 10 dB. These figures are design constraints and the actual figures will likely vary depending on the actual value of components used for the circuits 306 and 320. If the gain of the amplifiers 388, 394, and 400 of FIG. 12 are fixed, then the perspective curve 352 will remain constant. Adjustment of the amplifier 388 will tend to adjust the amplitude level of point B of the curve 352, thus varying the gain separation between points A and B, and points B and C.

Through the foregoing description and accompanying drawings, the present invention has been shown to have important advantages over current audio reproduction and enhancement systems. While the above detailed description has shown, described, and pointed out the fundamental novel features of the invention, it will be understood that various omissions and substitutions and changes in the form and details of the device illustrated may be made by those skilled in the art, without departing from the spirit of the invention. Therefore, the invention should be limited in its scope only by the following claims.

What is claimed is:

1. A system for processing at least four discrete audio signals including main left and right signals containing audio information intended for playback from a front sound stage, and surround left and right signals containing audio information intended for playback from a rear sound stage, said system generating a pair of left and right output signals for reproduction from the front sound stage to create the perception of a three dimensional sound image without the need for actual speakers placed in the rear sound stage, said system comprising:

a first electronic audio enhancer receiving said main left and right signals, said first audio enhancer processing an ambient component of said main left and right signals to create the perception of a broadened sound image across the front sound stage when said left and right output signals are reproduced by a pair of speakers positioned within the front sound stage;

a second electronic audio enhancer receiving said surround left and right signals, said second audio enhancer processing an ambient component of said surround left and right signals to create the perception of an acoustic sound image across the rear sound stage when said left and right output signals are reproduced by the pair of speakers positioned within the front sound stage;

a third electronic audio enhancer receiving said surround left and right signals, said third audio enhancer processing a monophonic component of said surround left and right signals to create the perception of an acoustic sound image at a center location of the rear sound stage when said left and right output signals are reproduced by the pair of speakers positioned within the front sound stage; and a signal mixer for generating said left and right output signals from the at least four discrete audio signals by combining the processed ambient component from the main left and right signals, the processed ambient component for the surround left and right signals, and the processed monophonic component from the surround left and right signals, wherein said ambient components of said main and surround signals are included in the left and right output signals in an out-of-phase relationship with respect to each other.

2. The system of claim 1 wherein said at least four discrete audio signals comprise a center channel signal containing audio information intended for playback by a front sound stage center speaker, and wherein said center channel signal is combined by said signal mixer as part of said left and right output signals.

3. The system of claim 1 wherein said at least four discrete audio signals comprise a center channel signal containing audio information intended for playback by a center speaker located within the front sound stage, and wherein said center channel signal is combined with a monophonic component of the main left and right signals by said signal mixer to generate said left and right output signals.

4. The system of claim 1 wherein said at least four discrete audio signals comprises a center channel signal having center stage audio information which is acoustically reproduced by a dedicated center channel speaker.

5. The system of claim 1 wherein said first, second, and third electronic audio enhancers apply an HRTF-based transfer function to a respective one of said discrete audio signals for creating an apparent sound image corresponding to said discrete audio signals when said left and right output signals are acoustically reproduced.

6. The system of claim 1 wherein said first audio enhancer equalizes said ambient component of said main left and right signals by boosting said ambient component below approximately 1 kHz and above approximately 2 kHz relative to frequencies between approximately 1 and 2 kHz.

7. The system of claim 6 wherein the peak gain applied to boost said ambient component, relative to the gain applied to said ambient component between approximately 1 and 2 kHz, is approximately 8 dB.

8. The system of claim 1 wherein said second and third audio enhancers equalize said ambient and monophonic components of said surround left and right signals by boosting said ambient and monophonic components below approximately 1 kHz and above approximately 2 kHz, relative to frequencies between approximately 1 and 2 kHz.

9. The system of claim 8 wherein the peak gain applied to boost said ambient and monophonic components of said surround left and right signals, relative to the gain applied to said ambient and monophonic components between approximately 1 and 2 kHz, is approximately 18 dB.

10. The system of claim 1 wherein said first, second, and third electronic audio enhancers are formed upon a semiconductor substrate.

11. The system of claim 1 wherein said first, second, and third electronic audio enhancers are implemented in software.

12. A multi-channel recording and playback apparatus receives a plurality of individual audio signals and processes said plurality of audio signals to provide first and second enhanced audio output signals for achieving an immersive sound experience upon playback of said output signals, said multi-channel recording apparatus comprising:

a plurality of parallel audio signal processing devices for modifying the signal content of said individual audio signals wherein each parallel audio signal processing device comprises:

a circuit for receiving two of said individual audio signals and isolating an ambient component of said two audio signals from a monophonic component of said two audio signals;

positional processing means capable of electronically applying a head related transfer function to each of said ambient and monophonic components of said two audio signals to generate processed ambient and monophonic components, said head related transfer functions corresponding to a desired spatial location with respect to a listener; and a multi-channel circuit mixer for combining said processed monophonic components and ambient components generated by said plurality of positional processing means to generate said enhanced audio output signals wherein said processed ambient components are combined in an out-of-phase relationship with respect to said first and second output signals.

13. The multi-channel recording and playback apparatus of claim 12 wherein each of said plurality of positional processing means further includes a circuit capable of individually modifying said two audio signals and wherein said multi-channel mixer further combines said two modified signals from said plurality of positional processing means with said respective ambient and monophonic components to generate said audio output signals.

14. The multi-channel recording and playback apparatus of claim 13 wherein said circuit capable of individually modifying said two audio signals electronically applies a head related transfer function to said two audio signals.

15. The multi-channel recording and playback apparatus of claim 13 wherein said circuit capable of individually modifying said two audio signals electronically applies a time delay to one of said two audio signals.

16. The multi-channel recording and playback apparatus of claim 12 wherein said two audio signals comprise audio information corresponding to a left front location and a right front location with respect to a listener.

17. The multi-channel recording and playback apparatus of claim 12 wherein said two audio signals comprise audio information corresponding to a left rear location and a right rear location with respect to a listener.

18. The multi-channel recording and playback apparatus of claim 12 wherein said plurality of parallel processing devices comprises first and second processing devices, said first processing device applying a head related transfer function to a first pair of said audio signals for achieving a first perceived direction for said first pair of audio signals when said output signals are reproduced, and said second processing device applying a head related transfer function to a second pair of said audio signals for achieving a second perceived direction for said second pair of audio signals when said output signals are reproduced.

19. The multi-channel recording and playback apparatus of claim 12 wherein said plurality of parallel audio processing devices and said multi-channel circuit mixer are implemented in a digital signal processing device of said multi-channel recording and playback apparatus.

20. An audio enhancement system for processing a plurality of audio source signals to create a pair of stereo output signals for generating a three dimensional sound field when said pair of stereo output signals are reproduced by a pair of loudspeakers, said audio enhancement system comprising:

a first processing circuit in communication with a first pair of said audio source signals, said first processing circuit configured to isolate a first ambient component and a first monophonic component from said first pair of audio signals, said first processing circuit further configured to modify said first ambient component and said first monophonic component to create a first acoustic image such that said first acoustic image is perceived by a listener as emanating from a first location;

a second processing circuit in communication with a second pair of said audio source signals, said second processing circuit configured to isolate a second ambient component and a second monophonic component from said second pair of audio signals, said second processing circuit further configured to modify said second ambient component and said second monophonic component to create a second acoustic image, such that said second acoustic image is perceived by said listener as emanating from a second location; and a mixing circuit in communication with said first processing circuit and said second processing circuit, said mixing circuit configured to combine said first and second modified monophonic components in phase and combine said first and second modified ambient components out of phase to generate a pair of stereo output signals.

21. The system of claim 20 wherein said first processing circuit is further configured to modify a plurality of frequency components in said first ambient component with a first transfer function.

22. The system of claim 21 wherein said first transfer function is further configured to emphasize a portion of the low frequency components in said first ambient component relative to other frequency components in said first ambient component.

23. The system of claim 21 wherein said first transfer function is configured to emphasize a portion of the high frequency components of said first ambient component relative to other frequency components in said first ambient component.

24. The system of claim 21 wherein said second processing circuit is configured to modify a plurality of frequency components in said second ambient component with a second transfer function.

25. The system of claim 24 wherein said second transfer function is configured to modify said frequency components in said second ambient component in a different manner than said first transfer function modifies said frequency components in said first ambient component.

26. The system of claim 24 wherein said second transfer function is configured to deemphasize a portion of said frequency components above approximately 11.5 kHz relative to other frequency components in said second ambient component.

27. The system of claim 24 wherein said second transfer function is configured to deemphasize a portion of said frequency components between approximately 125 Hz and approximately 2.5 khz relative to other frequency components in said second ambient component.

28. The system of claim 24 wherein said second transfer function is configured to increase a portion of said frequency components between approximately 2.5 khz and approximately 11.5 khz relative to other frequency components in said second ambient component.

29. A multi-track audio processor receiving a plurality of separate audio signals as part of a composite audio source, said plurality of audio signals comprising at least two distinct audio signal pairs containing audio information which is desirably interpreted by a listener as emanating from distinct locations within a sound listening environment, said multi-track audio processor comprising:

first electronic means receiving a first pair of said audio signals, said first electronic means separately applying a head related transfer function to an ambient component of said first pair of audio signals for creating a first acoustic image wherein said first acoustic image is perceived by a listener as emanating from a first location;

second electronic means receiving a second pair of said audio signals, said second electronic means separately applying a head related transfer function to an ambient component and a monophonic component of said second pair of audio signals for creating a second acoustic image wherein said second acoustic image is perceived by the listener as emanating from a second location; and means for mixing said components of said first and second pair of audio signals received from said first and second electronic means, said means for mixing combining said ambient components out of phase to generate said pair of stereo output signals.

30. An entertainment system having two main audio reproduction channels for reproducing an audio-visual recording to a user wherein said audio-visual recording comprises five discrete audio signals including a front-left signal, $F_L$, a front-right signal, $F_R$, a rear-left signal, $R_L$, a rear-right signal, $R_R$, and a center signal, C, and wherein said entertainment system achieves a surround sound experience for said user from said two main audio channels, said entertainment system comprising:

an audio-visual playback device for extracting said five discrete audio signals from said audio-visual recording;

an audio processing device for receiving said five discrete audio signals and generating said two main audio reproduction channels, said audio processing device comprising:

a first processor for equalizing an ambient component of said front signals, $F_L$ and $F_R$, to obtain a spatially-corrected ambient component $(F_L-F_R)_P$;

a second processor for equalizing an ambient component of said rear signals, $R_L$ and $R_R$, to obtain a spatially-corrected ambient component $(R_L-R_R)_P$;

a third processor for equalizing a direct-field component of said rear signals, $R_L$ and $R_R$, to obtain a spatially-corrected direct-field component $(R_L+R_R)_P$;

a left mixer for generating a left output signal, said left mixer combining the spatially-corrected ambient component, $(F_L-F_R)_P$, with said spatially-corrected ambient component, $(R_L-R_R)_P$, and said spatially-corrected direct-field component, $(R_L+R_R)_P$, to create said left output signal; and a right mixer for generating a right output signal, said right mixer combining an inverted spatially-corrected ambient component, $(F_R-F_L)_P$, with an inverted spatially-corrected ambient component, $(R_R-R_L)_P$, and said spatially-corrected direct-field component, $(R_L+R_R)_P$, to create said right output signal; and means for reproducing said left and right output signals through said two main channels in connection with playback of said audio-visual recording to create a surround sound experience for said user.

31. The entertainment system of claim 30 wherein said center signal is input by said left mixer and combined as part of said left output signal and said center signal is combined by said right mixer and combined as part of said right output signal.

32. The entertainment system of claim 30 wherein said center signal and a direct field component of said front signals, $F_L+F_R$, are combined by said left and right mixers as part of said left and right output signals, respectively.

33. The entertainment system of claim 30 wherein said center signal is provided as a third output signal for reproduction by a center channel speaker of said entertainment system.

34. The entertainment system of claim 30 wherein said entertainment system is a personal computer and said audio-visual playback device is a digital versatile disk (DVD) player.

35. The entertainment system of claim 30 wherein said entertainment system is a television and said audio-visual playback device is an associated digital versatile disk (DVD) player connected to said television system.

36. The entertainment system of claim 30 wherein said first, second, and third processors emphasize a low and high range of frequencies relative to a mid-range of frequencies.

37. The entertainment system of claim 30 wherein said audio processing device is implemented as an analog circuit formed upon a semiconductor substrate.

38. The entertainment system of claim 30 wherein said audio processing device is implemented in a software format, said software format executed by a microprocessor of said entertainment system.

39. A method of enhancing a group of audio source signals wherein the audio source signals are designated for speakers placed around a listener to create left and right output signals for acoustic reproduction by a pair of speakers in order to simulate a surround sound environment, the audio source signals comprising a left-front signal ($L_F$), a right-front signal ($R_F$), a left-rear signal ($L_R$), and a right-rear signal ($R_R$), said method of enhancing comprising the following steps:

modifying said audio source signals to create processed audio signals based on the audio content of selected pairs of said source signals, said processed audio signals defined in accordance with the following equations:

$$P_1=F_1(L_F-R_F),$$

$$P_2=F_2(L_R-R_R),$$

and $$P_3=F_3(L_R+R_R),$$

where $F_1$, $F_2$, and $F_3$ are transfer functions for emphasizing the spatial content of an audio signal to achieve a perception of depth with respect to a listener upon playback of the resultant processed audio signal by a loudspeaker, and combining said processed audio signals with said audio source signals to create said left and right output signals, said left and right output signals comprising the components recited in the following equations:

$$L_{OUT}=K_1L_F+K_2L_R+K_3P_1+K_4P_2+K_5P_3,$$

$$R_{OUT}=K_6R_F+K_7R_R-K_8P_1-K_9P_2+K_{10}P_3,$$

where $K_1$–$K_{10}$ are independent variables which determine the gain of the respective audio signal.

40. The method of enhancing a group of audio source signals as recited in claim 39 wherein the transfer functions F1, F2, and F3 apply a level of equalization characterized by amplification of frequencies between approximately 50 and 500 Hz and between approximately 4 and 15 kHz relative to frequencies between approximately 500 Hz and 4 kHz.

41. The method of enhancing a group of audio source signals as recited in claim 39 wherein the left and right output signals further comprise a center channel audio source signal.

42. The method of enhancing a group of audio source signals as recited in claim 39 wherein said method is performed by a digital signal processing device.

43. A method of creating a simulated surround sound experience through reproduction of first and second output signals within an entertainment system having a source of at least four audio signals wherein said at least four audio source signals comprise a pair of front audio signals representing audio information emanating from a forward sound stage with respect to a listener, and a pair of rear audio signals representing audio information emanating from a rear sound stage with respect to the listener, said method comprising the following steps:

combining said front audio signals to create a front ambient component signal and a front direct component signal, combining said rear audio signals to create a rear ambient component signal and a rear direct component signal, processing the front ambient component signal with a first HRTF-based transfer function to create a perceived source of direction of said front ambient component about a forward left and right aspect with respect to the listener, processing the rear ambient component signal with a second HRTF-based transfer function to create a perceived source of direction of said rear ambient component about a rear left and right aspect with respect to the listener, processing the rear direct component signal with a third HRTF-based transfer function to create a perceived source of direction of said rear direct component at a rear center aspect with respect to the listener, and combining a first one of said front audio signals, a first one of said rear audio signals, said processed front ambient component, said processed rear ambient component, and said processed rear direct component to create said first output signal, combining a second one of said front audio signals, a second one of said rear audio signals, said processed front ambient component, said processed rear ambient component, and said processed rear direct component to create said second output signal, and reproducing said first and second output signals, respectively, through a pair of speakers situated in said forward sound stage with respect to the listener.

44. The method of claim 43 wherein said first, second, and third HRTF-based transfer functions equalize a respective inputted through amplification of signal frequencies between approximately 50 and 500 Hz and between approximately 4 and 15 kHz relative to frequencies between approximately 500 Hz and 4 kHz.

45. The method of claim 43 wherein the entertainment system is a personal computer system and said at least four audio source signals are generated by a digital video disk player attached to said computer system.

46. The method of claim 43 wherein the entertainment system is a television and said at least four audio source signals are generated by an associated digital video disk player connected to said television system.

47. The method of claim 43 wherein said at least four audio signals comprise a center channel audio signal, said center channel signal electronically added to said first and second output signals.

48. The method of claim 43 wherein said steps of processing with said first, second, and third HRTF-based transfer functions is performed by a digital signal processor.

* * * * *